US010114301B2

(12) United States Patent
Okuda et al.

(10) Patent No.: US 10,114,301 B2
(45) Date of Patent: Oct. 30, 2018

(54) ELECTROPHOTOGRAPHIC PHOTORECEPTOR, PROCESS CARTRIDGE, AND ELECTROPHOTOGRAPHIC APPARATUS

(71) Applicant: CANON KABUSHIKI KAISHA, Tokyo (JP)

(72) Inventors: Atsushi Okuda, Yokohama (JP); Yuka Ishiduka, Suntou-gun (JP); Atsushi Fujii, Yokohama (JP); Akihiro Maruyama, Mishima (JP); Kazunori Noguchi, Suntou-gun (JP); Nobuhiro Nakamura, Numazu (JP); Yuki Yamamoto, Shiroi (JP); Kazuko Araki, Tokyo (JP); Tatsuya Ikezue, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 212 days.

(21) Appl. No.: 15/286,379

(22) Filed: Oct. 5, 2016

(65) Prior Publication Data

US 2017/0102627 A1 Apr. 13, 2017

(30) Foreign Application Priority Data

Oct. 9, 2015 (JP) ..... 2015-201312

(51) Int. Cl.
*G03G 5/04* (2006.01)
*G03G 15/00* (2006.01)
(Continued)

(52) U.S. Cl.
CPC ..... *G03G 5/04* (2013.01); *G03G 5/043* (2013.01); *G03G 5/142* (2013.01); *G03G 15/751* (2013.01)

(58) Field of Classification Search
CPC ..... G03G 5/04; G03G 5/043; G03G 5/142; G03G 15/75; G03G 15/751; G03G 15/752
(Continued)

(56) References Cited

U.S. PATENT DOCUMENTS

2006/0188803 A1* 8/2006 Yabuki ..... G03G 5/08 430/118.7
2009/0052942 A1* 2/2009 Lin ..... G03G 5/047 399/159
(Continued)

FOREIGN PATENT DOCUMENTS

JP 3717320 B2 11/2005
JP 2014029480 A 2/2014

*Primary Examiner* — Billy Lactaoen
(74) *Attorney, Agent, or Firm* — Canon U.S.A., Inc. IP Division

(57) ABSTRACT

An electrophotographic photoreceptor abuts against a charging member and/or a developer carrying member with an abutting member therebetween, has a first portion and a second portion abutting against the abutting member along the longitudinal direction of the photoreceptor, and includes a support, a charge generating layer containing a charge generation material, and a surface layer in this order. The first portion includes an undercoat layer containing a polymer of a composition containing an electron transport material and a crosslinking agent and being contiguous with the surface of the charge generating layer facing the support. The second portion includes (i) an intermediate layer being disposed between and being contiguous with the support and the charge generating layer and/or (ii) an intermediate layer being disposed between and being contiguous with the charge generating layer and the surface layer, wherein the intermediate layers each have a Martens hardness of 500 N/mm$^2$ or less.

19 Claims, 2 Drawing Sheets

(51) Int. Cl.
*G03G 5/043* (2006.01)
*G03G 5/14* (2006.01)

(58) Field of Classification Search
USPC ..... 399/116, 111
See application file for complete search history.

(56) References Cited

U.S. PATENT DOCUMENTS

2012/0034556 A1* 2/2012 Nebashi ..... G03G 5/142
430/65
2016/0054667 A1* 2/2016 Ito ..... G03G 5/144
399/159

* cited by examiner

ELECTROPHOTOGRAPHIC PHOTORECEPTOR, PROCESS CARTRIDGE, AND ELECTROPHOTOGRAPHIC APPARATUS

BACKGROUND OF THE INVENTION

Field of the Invention

The present invention relates to an electrophotographic photoreceptor, a process cartridge, and an electrophotographic apparatus.

Description of the Related Art

An electrophotographic photoreceptor is mounted on a process cartridge or an electrophotographic apparatus. In order to enhance the quality of images formed by an electrophotographic image forming process, an electrophotographic photoreceptor provided with an undercoat layer containing a polymer of a composition containing an electron transport material and a crosslinking agent is known (Japanese Patent Laid-Open No. 2014-29480). According to the description in Japanese Patent Laid-Open No. 2014-29480, such a structure prevents the formation of positive ghosts. The positive ghost is a phenomenon that only a portion irradiated with light during pre-rotation of an electrophotographic photoreceptor has a high image density in the output image and is one of technical issues that decrease the quality of a resulting image.

SUMMARY OF THE INVENTION

The electrophotographic photoreceptor according to aspects of the present invention abuts against at least one member, with an abutting member therebetween, selected from a charging member for charging the electrophotographic photoreceptor and a developer carrying member for supplying a developer to the electrophotographic photoreceptor. The electrophotographic photoreceptor has a first portion and a second portion, different from the first portion, along the longitudinal direction of the photoreceptor. The electrophotographic photoreceptor abuts against the abutting member in the second portion. The electrophotographic photoreceptor includes a support, a charge generating layer containing a charge generation material, and a surface layer in this order. In the first portion, the electrophotographic photoreceptor includes an undercoat layer containing a polymer of a composition containing an electron transport material and a crosslinking agent so as to be contiguous with the surface of the charge generating layer facing the support. In the second portion, the electrophotographic photoreceptor includes at least one of:

(i) an intermediate layer disposed between and so as to be contiguous with the support and the charge generating layer; and (ii) an intermediate layer disposed between and so as to be contiguous with the charge generating layer and the surface layer, wherein the intermediate layers each have a Martens hardness of 500 $N/mm^2$ or less.

Further features of the aspects of the present invention will become apparent from the following description of exemplary embodiments with reference to the attached drawings.

BRIEF DESCRIPTION OF THE DRAWINGS

FIG. 2 is a diagram schematically illustrating the structure of an electrophotographic apparatus including a process cartridge provided with the electrophotographic photoreceptor of the aspects of the present invention.

DESCRIPTION OF THE EMBODIMENTS

Figures 1, 1A:
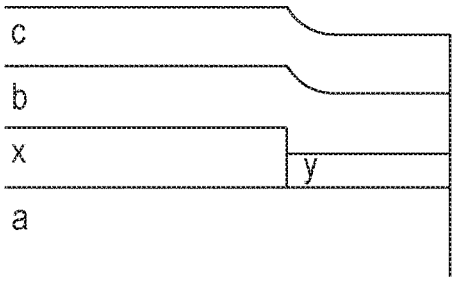
FIGS. 1A-1, 1A-2, 1B-1, and 1B-2 illustrate examples of the layer configuration of the electrophotographic photoreceptor of the aspects of the present invention.

On the periphery of an electrophotographic photoreceptor, for example, a charging unit, an exposing unit, a developing unit, a transferring unit, and a cleaning unit are disposed. An image is formed through steps performed by these units. Among these units, a charging member for charging the electrophotographic photoreceptor and a developer carrying member for supplying a developer to the electrophotographic photoreceptor abut against an end part of the electrophotographic photoreceptor with an abutting member, such as a spacing member, therebetween. The electrophotographic photoreceptor receives a large stress at this abutting portion and thereby has a risk of peeling the layers at the abutting portion by repeated use for a long time. In particular, as described in Japanese Patent Laid-Open No. 2014-29480, when an undercoat layer containing a polymer of a composition containing an electron transport material and a crosslinking agent is disposed under a charge generating layer containing a charge generation material so as to be contiguous with the charge generating layer, significant peeling occurs at the interface between the undercoat layer and the charge generating layer in some cases.

Consequently, it has been studied to dispose the undercoat layer only in the image forming region of the electrophotographic photoreceptor, that is, not disposing the undercoat layer at an end part where the abutting member abuts against the electrophotographic photoreceptor. However, peeling of the layers of the electrophotographic photoreceptor occurred in the abutting portion.

Accordingly, aspects of the present invention provides an electrophotographic photoreceptor prevented from peeling of layers at the end part where an abutting member abuts, even if an undercoat layer is disposed for improving the image quality, and provides a process cartridge and an electrophotographic apparatus including the electrophotographic photoreceptor.

The aspects of the present invention will now be described in detail by embodiments.

The present inventors have investigated the causes of peeling of the layers at the end part where an abutting member abuts and have found that the stress received by the abutting portion causes strain between the layers. The inventors have accordingly investigated a method for relieving the strain by the stress between the layers by disposing a layer having stress-relieving activities and, as a result, have found that peeling of layers can be prevented by disposing a layer satisfying a specific Martens hardness between specific layers.

The electrophotographic photoreceptor of the aspects of the present invention includes a support, a charge generating layer containing a charge generation material, and a surface layer in this order. The electrophotographic photoreceptor further has a first portion and a second portion different from the first portion along the longitudinal direction. The first portion serves as an image forming region, and the second portion is a region having a surface abutting against a spacing member. Furthermore, the electrophotographic photoreceptor includes an undercoat layer containing a polymer of a composition containing an electron transport material and a crosslinking agent in the first portion so as to be contiguous with the surface of the charge generating layer facing the support, and includes at least one of (i) an intermediate layer disposed between and so as to be contiguous with the support and the charge generating layer and (ii) an intermediate layer disposed between and so as to be contiguous with the charge generating layer and the surface layer in the second portion, wherein the intermediate layers each have a Martens hardness of 500 $N/mm^2$ or less.

More specifically, the first portion of the electrophotographic photoreceptor includes a support a, an undercoat layer x, a charge generating layer b, and a surface layer c in this order. The second portion of the electrophotographic photoreceptor includes a support a, an intermediate layer y, a charge generating layer b, and a surface layer c in this order in the cases shown in FIGS. 1A-1 and 1B-1 or includes a support a, a charge generating layer b, an intermediate layer y, and a surface layer c in this order in the cases shown in FIGS. 1A-2 and 1B-2.

Figures 1, 1A, 2:
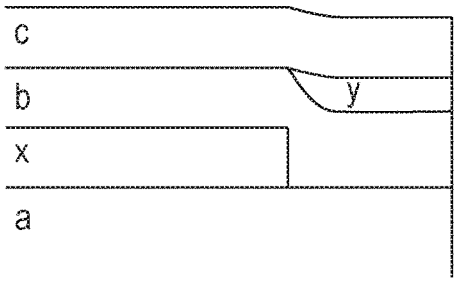
Figures 1, 1B:
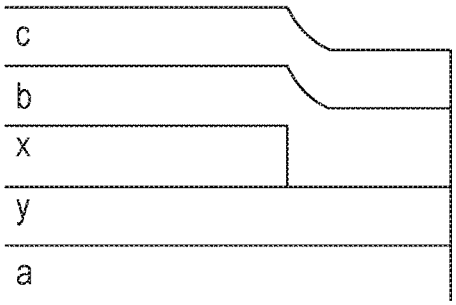
Figures 1, 1B, 2:
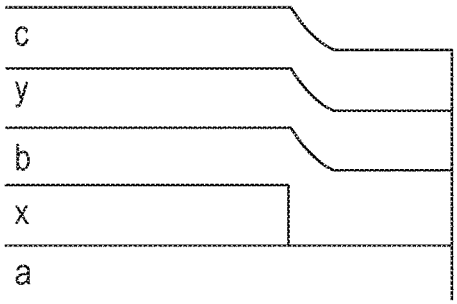
Figure 2:
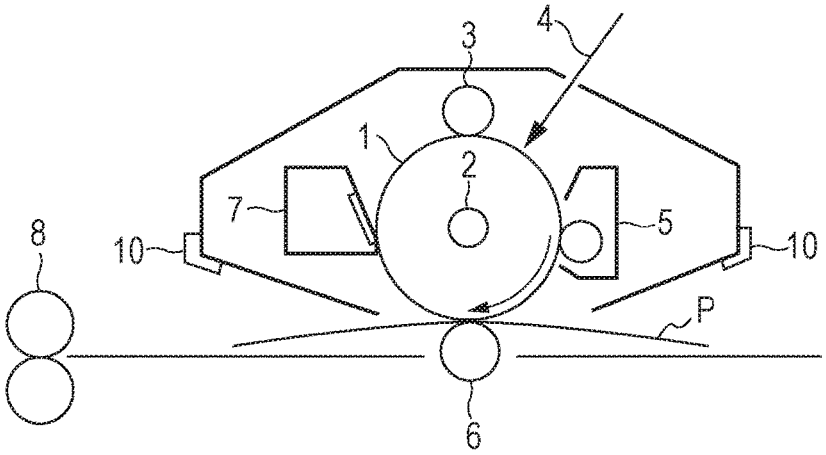

In the electrophotographic photoreceptor, the intermediate layer may be disposed (A) only at the second portion (FIGS. 1A-1 and 1A-2) or may be disposed (B) over the second portion and the first portion (FIGS. 1B-1 and 1B-2). Although both cases can achieve the effects of the aspects of the present invention, i.e., can prevent peeling of layers, case (A) can provide higher quality to the resulting images.

In cases (A) and (B), an undercoat layer x is arranged in the first portion as follows:

(A) in both cases (i) (FIG. 1A-1) and (ii) (FIG. 1A-2), an undercoat layer is disposed between and so as to be contiguous with the support a and the charge generating layer b; and (B) in case (i) (FIG. 1B-1), an undercoat layer is disposed between and so as to be contiguous with the intermediate layer y and the charge generating layer b; and in case (ii) (FIG. 1B-2), an undercoat layer is disposed between and so as to be contiguous with the charge generating layer b and the surface layer c.

[Process Cartridge]

The process cartridge of the aspects of the present invention is detachably attached to the main body of an electrophotographic apparatus. The process cartridge includes an electrophotographic photoreceptor and at least one selected from a charging member for charging the electrophotographic photoreceptor and a developer carrying member for supplying a developer to the electrophotographic photoreceptor. The charging member and/or the developer carrying member includes an abutting member, such as a spacing member for maintaining a distance from the electrophotographic photoreceptor and may further include a transferring member or a cleaning member.

<Electrophotographic Photoreceptor>

The electrophotographic photoreceptor of the aspects of the present invention includes a support, a charge generating layer, and a surface layer in this order. The electrophotographic photoreceptor further includes an undercoat layer directly under and so as to be contiguous with the charge generating layer in the first portion and includes an intermediate layer between specific layers in the second portion. The surface of the first portion of the photoreceptor includes a region capable of forming an image (image forming region). The surface of the second portion of the photoreceptor includes a region against which an abutting member abuts. The second portion can be an end part of the photoreceptor. Such a configuration, i.e., a configuration in which an end part of the photoreceptor abuts against the abutting member, can maximize the image forming region. The second portion can be disposed at each end part of the photoreceptor and can be disposed in a range of 20 mm or less from the end of the photoreceptor in the longitudinal direction.

The electrophotographic photoreceptor can be produced by, for example, preparing coating solutions for the layers described below, applying the solutions in an intended order of the layers, and drying the coating films. Examples of the method for applying the coating solutions include dip coating, spray coating, curtain coating, and spin coating. In particular, the dip coating is excellent in efficiency and productivity.

Each layer will now be described in detail. The average thickness of each layer is determined by measuring thicknesses at five points of a layer with a film thickness meter (Fischer MMS Eddy Current Probe EAW3.3, manufactured by Fischer Instruments K.K.) and calculating the average thereof. When the thickness measured by this method is 1 μm or less, the thicknesses at five points are measured with a film thickness measuring system (F20, manufactured by Filmetrics, Inc.) and average thereof is calculated. (Support)

In the aspects of the present invention, the support can have conductivity. Examples of the conductive support include supports made of metals, such as aluminum, iron, nickel, copper, and gold, or alloys thereof; and supports each composed of an insulating support and a thin film formed thereon, where the insulating support is, for example, a polyester resin, a polycarbonate resin, a polyimide resin, or glass; and the thin film is, for example, a metal thin film, such as an aluminum, chromium, silver, or gold thin film, a conductive material thin film, such as an indium oxide, tin oxide, or zinc oxide thin film, or a thin film of a conductive ink containing silver nanowires.

The surface of the support may be subjected to, for example, electrochemical treatment such as anodization, wet honing treatment, blast treatment, or cutting treatment, for improving the electrical properties or preventing interference fringes.

(Conductive Layer)

In the aspects of the present invention, a conductive layer may be disposed on the support. The conductive layer can contain metal oxide particles.

The conductive layer can be formed by preparing a conductive layer coating solution and applying the solution to the support. The conductive layer coating solution can contain a solvent together with the metal oxide particles. Examples of the solvent include alcohol solvents, sulfoxide solvents, ketone solvents, ether solvents, ester solvents, and aromatic hydrocarbon solvents. The metal oxide particles can be dispersed in the conductive layer coating solution by, for example, a method using a paint shaker, a sand mill, a ball mill, or a liquid collision-type high-speed disperser. The surfaces of the metal oxide particles may be treated with, for example, a silane coupling agent for improving the dispersibility of the metal oxide particles. Furthermore, the metal oxide particles may be doped with another metal or metal oxide for reducing the electrical resistance of the conductive layer.

Examples of the metal oxide particle include zinc oxide, white lead, aluminum oxide, indium oxide, silicon oxide, zirconium oxide, tin oxide, titanium oxide, magnesium oxide, antimony oxide, bismuth oxide, indium oxide doped with tin, tin oxide doped with antimony or tantalum, and zirconium oxide particles. Among these particles, particles of zinc oxide, titanium oxide, and tin oxide can be particularly used.

The metal oxide particles can have a number-average particle diameter of 30 to 450 nm, more preferably 30 to 250 nm, for preventing occurrence of black spots due to formation of a local conduction path.

The conductive layer can further contain resin particles having an average particle diameter of 1 μm or more and 5 μm or less. Such a configuration roughens the surface of the conductive layer and thereby can prevent the interference of light reflected by the surface of the conductive layer, resulting in prevention of occurrence of interference fringes in the output image. Examples of the resin particles include thermosetting resin particles, such as curable rubber, polyurethane, epoxy resin, alkyd resin, phenolic resin, polyester, silicone resin, and acryl-melamine resin particles. Among these particles, silicone resin particles hardly aggregate and can be particularly used.

The conductive layer can have an average thickness of 2 μm or more and 40 μm or less, more preferably 10 μm or more and 30 μm or less.

The surface of the conductive layer can have a ten-point average roughness $Rz_{JIS}$ (reference length: 0.8 mm) in accordance with JIS B 0601:2001 of 0.5 μm or more and 2.5 μm or less.

(Charge Generating Layer)

In the aspects of the present invention, the charge generating layer contains a charge generation material. In the first portion of the electrophotographic photoreceptor, the surface of the charge generating layer facing the support (the surface on the opposite side of the surface of the charge generating layer facing the surface layer) is contiguous with an undercoat layer described below.

The charge generation material may be a known material. Examples of the material include azo pigments, perylene pigments, anthraquinone derivatives, anthoanthrone derivatives, dibenzpyrenequinone derivatives, pyranthrone derivatives, violanthrone derivatives, isoviolanthrone derivatives, indigo derivatives, thioindigo derivatives, phthalocyanine pigments such as metal phthalocyanine and metal-free phthalocyanine, and bisbenzimidazole derivatives. Among these materials, azo pigments and phthalocyanine pigments can be particularly used. Among the phthalocyanine pigments, oxytitanium phthalocyanine, chlorogallium phthalocyanine, and hydroxygallium phthalocyanine can be particularly used.

The charge generating layer may further contain a resin. Examples of the resin include polyacetal resins; polymers and copolymers of vinyl compounds such as styrene, vinyl acetate, vinyl chloride, acrylates, methacrylates, vinylidene fluoride, and trifluoroethylene; polyvinyl alcohol resins; polycarbonate resins; polyester resins; polysulfone resins; polyphenylene oxide resins; polyurethane resins; cellulose resins; phenolic resins; melamine resins; silicone resins; and epoxy resins. The charge generating layer can contain a polyacetal resin from the viewpoint of adhesiveness to a contiguous layer. Commercially available examples of the polyacetal resin include S-LEC series, such as BX-1, BM-1, KS-1, and KS-5 (manufactured by Sekisui Chemical Co., Ltd.). The resin can have a weight-average molecular weight of 100 or more and 10000 or less.

The mass ratio of the content of the charge generation material to the content of the resin (content of the charge generation material/content of the resin) in the charge generating layer can be 0.1 or more and 10 or less, more preferably 0.2 or more and 5 or less.

The charge generating layer can have an average thickness of 0.05 μm or more and 5 μm or less, more preferably 0.1 μm or more and 1 μm or less.

The average thickness of the charge generating layer in the second portion (the region against which an abutting member abuts) can be smaller than that of the charge generating layer in the first portion (image forming region). Such a configuration inhibits the discharge phenomenon occurring between the second portion (the region against which an abutting member abuts) of the photoreceptor and a charging member or a developer carrying member, resulting in prevention of the wear of the photoreceptor caused by the discharge phenomenon.

The charge generating layer can be formed by preparing a charge generating layer coating solution and applying the solution. The charge generating layer coating solution can contain a solvent together with the charge generation material and the resin. Examples of the solvent include alcohol solvents, sulfoxide solvents, ketone solvents, ether solvents, ester solvents, and aromatic hydrocarbon solvents.

(Surface Layer)

In the aspects of the present invention, the surface layer is the outermost surface of the electrophotographic photoreceptor. Specifically, the surface layer is, for example, composed of a charge transporting layer alone, composed of a surface protecting layer alone, or composed of a charge transporting layer and a surface protecting layer. Each of the charge transporting layer and the surface protecting layer will now be described.

(1) Charge Transporting Layer

In the aspects of the present invention, the charge transporting layer can contain a charge transport material and a resin.

Examples of the charge transport material include polycyclic aromatic compounds, heterocyclic compounds, hydrazone compounds, styryl compounds, benzidine compounds, triarylamine compounds, triphenylamine, and polymers having groups derived from these compounds as the main chains or side chains. Among these compounds, triarylamine compounds, benzidine compounds, and styryl compounds can be particularly used.

Examples of the resin include polyester resins, polycarbonate resins, polymethacrylate resins, polyarylate resins, polysulfone resins, and polystyrene resins. Among these resins, polycarbonate resins and polyarylate resins can be particularly used. The resin can have a weight-average molecular weight of 10000 or more and 300000 or less.

The mass ratio of the content of the charge transport material to the content of the resin (content of the charge transport material/content of the resin) in the charge transporting layer can be 0.5 or more and 2 or less, more preferably 0.6 or more and 1.25 or less.

The charge transporting layer can have an average thickness of 3 μm or more and 40 μm or less, more preferably 5 μm or more and 25 μm or less, and most preferably 5 μm or more and 16 μm or less.

The charge transporting layer can be formed by preparing a charge transporting layer coating solution and applying the solution. The charge transporting layer coating solution can contain a solvent together with the charge transport material and the resin. Examples of the solvent include alcohol solvents, sulfoxide solvents, ketone solvents, ether solvents, ester solvents, and aromatic hydrocarbon solvents.

(2) Surface Protecting Layer

In the aspects of the present invention, the surface protecting layer contains, for example, conductive particles, a charge transport material, and a resin. Examples of the conductive particles include metal oxide particles, such as tin oxide particles. The surface protecting layer may contain an additive such as a lubricant. If the resin itself has conductivity or charge transportability, the conductive particles or the charge transport material may not be contained.

In another example, the surface protecting layer contains a resin being a cured product of a composition containing a charge transporting compound. Examples of the charge transporting compound in such a case include compounds having (meth)acryloyloxy groups. These compounds are polymerized by irradiation with radioactive rays, such as electron rays or gamma rays, and are cured.

The surface protecting layer can have a thickness of 0.1 μm or more and 20 μm or less, more preferably 1 μm or more and 10 μm or less.

Furthermore, the surface protecting layer may have a specific surface profile for reducing the friction with, for example, a cleaning member. Examples of the surface profile include a surface provided with a plurality of depressions, a surface provided with a plurality of protrusions, a surface provided with a plurality of grooves, and a surface provided with a combination thereof. These surface profiles can be formed by, for example, pressing a mold having a corresponding shape to the surface protecting layer. Although pressing of the mold also has a risk of peeling of a layer, the configuration of the electrophotographic photoreceptor of the aspects of the present invention can prevent such peeling of a layer.

(Undercoat Layer)

In the aspects of the present invention, the undercoat layer contains a polymer of a composition containing an electron transport material and a crosslinking agent. The composition may further contain an electron transport material, a crosslinking agent, and a resin. The mass ratio of the content of the electron transport material to the content of the other materials (such as the crosslinking agent and the resin) in the composition can be 2/7 to 8/2, more preferably 3/7 to 7/3. The polymerization temperature of the composition can be 120° C. to 200° C.

The undercoat layer can have an average thickness of 0.3 μm or more and 15 μm or less, more preferably 0.5 μm or more and 5.0 μm or less.

In the aspects of the present invention, the undercoat layer can be absent in the second portion. In the aspects of the present invention, the undercoat layer can be formed so as to be absent in the second portion by, for example, preparing an undercoat layer coating solution and applying the solution to only the first portion, which is the image forming region, or applying the solution to the whole photoreceptor and then removing the undercoat layer in the second portion. The former method can be carried out by, for example, dipping the photoreceptor into an undercoat layer coating solution such that the second portion is not dipped. The latter method can be carried out by, for example, dipping the photoreceptor into an undercoat layer coating solution and then applying a solvent that can dissolve the undercoat layer to the second portion with a peeling member, such as a rubber blade, a brush, a sponge, or a fiber cloth, to remove the undercoat layer.

However, the former method has a risk of infiltration of the coating solution into the second portion, whereas the latter method has a risk of incomplete peeling of the undercoat layer in the second portion. In those methods, although the undercoat layer may be present in a part of the second portion, the effects of the aspects of the present invention can be achieved.

More specifically, when the undercoat layer is partially present in the second portion, the area of the undercoat layer present in the region being in contact with the abutting member (the total area of the undercoat layer present in the region that can be in contact with the abutting member/the total area of the region that can be in contact with the abutting member) can be 80% or less, more preferably 50% or less. The area of the undercoat layer can be measured from the final photoreceptor as follows.

The layers upper than the undercoat layer of the electrophotographic photoreceptor are peeled using a solvent. In an image of the entire circumference of the region that can be in contact with the abutting member in the second portion of the electrophotographic photoreceptor observed with Hybrid Laser Microscope (manufactured by Lasertec Corporation) under the following conditions, the area of the region having a luminance of 200 or more is defined as "the total area of the undercoat layer present in the region that can be in contact with the abutting member".

(Measurement Conditions)

Light source: mercury-xenon lamp

Irradiation wavelength: 633 nm

Light receiving range: only red region of 3CCD

Objective lens: 5-fold magnification (NA: 0.15)

Light quantity to be set: 700

The "the total area of the region that can be in contact with the abutting member" refers to the surface area of the entire circumference corresponding to the width of the abutting member in the second section of the electrophotographic photoreceptor. For example, when the abutting member has a width of 4 mm and a cylinder has a diameter of 30 mm, the area is 376.8 mm calculated by multiplying 4 (mm) by the circumference length [30 (mm)×3.14].

The electron transport material, the crosslinking agent, and the resin will now be described.

(1) Electron Transport Material

Electron Transport Material

Examples of the electron transport material include quinone compounds, imide compounds, benzimidazole compounds, and cyclopentadienylidene compounds. In the aspects of the present invention, the electron transport material can have a polymerizable functional group, in particular, two or more polymerizable functional groups in one molecule. Examples of the polymerizable functional group include hydroxy, thiol, amino, carboxyl, and methoxy groups. In the aspects of the present invention, the electron transport material can be at least one selected from the compounds shown in the following Formulae (A1) to (A11).

(A1)

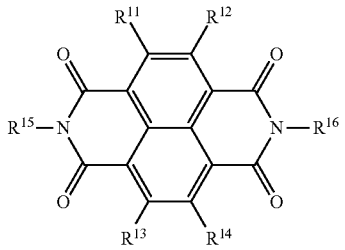

(A2)

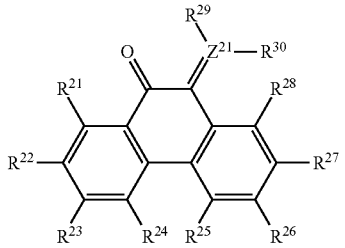

-continued (A3)

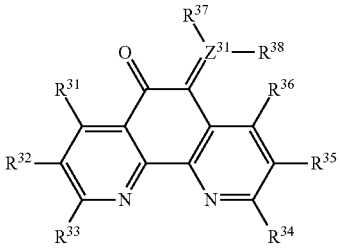

(A4)

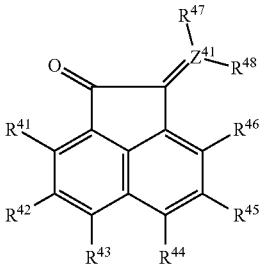

(A5)

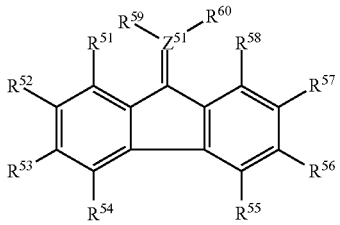

(A6)

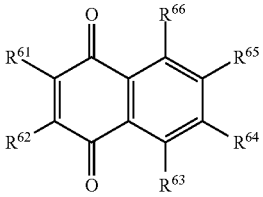

(A7)

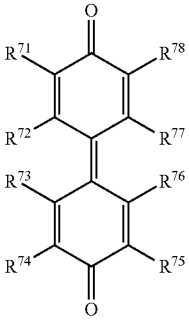

(A8)

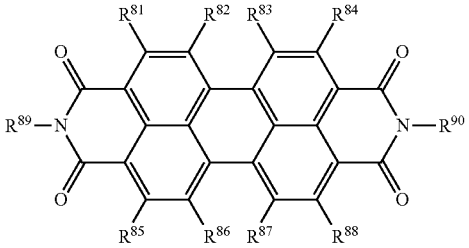

-continued (A9)

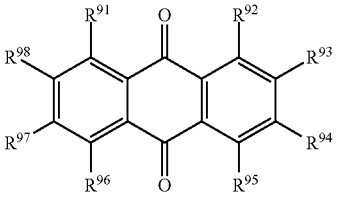

(A10)

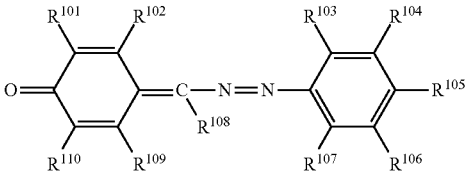

(A11)

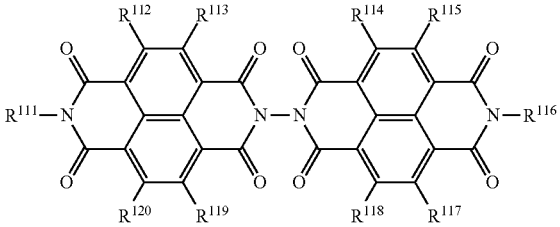

In Formulae (A1) to (A11), at least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$, and at least one of $R^{111}$ to $R^{120}$ independently represent a monovalent group represented by Formula (A); and other substituents each independently represent a hydrogen atom, a cyano group, a nitro group, a halogen atom, an alkoxycarbonyl group, an alkyl group, an aryl group, a heterocycle, or an alkyl group having a main chain in which one $CH_2$ is substituted with O, S, NH, or $NR^{121}$ ($R^{121}$ represents an alkyl group). The alkyl group, the aryl group, and the heterocycle may further have substituents. Examples of the substituent of the alkyl group include alkyl groups, aryl groups, halogen atoms, and alkoxycarbonyl groups. Examples of the substituent of the aryl group or the heterocycle include halogen atoms, a nitro group, a cyano group, alkyl groups, halogen-substituted alkyl groups, and alkoxy groups.

$Z^{21}$, $Z^{31}$, $Z^{41}$, and $Z^{51}$ each independently represent a carbon atom, a nitrogen atom, or an oxygen atom. When $Z^{21}$ represents an oxygen atom, $R^{29}$ and $R^{30}$ are not present, and when $Z^{21}$ represents a nitrogen atom, $R^{30}$ is not present. When $Z^{31}$ represents an oxygen atom, $R^{37}$ and $R^{38}$ are not present, and when $Z^{31}$ represents a nitrogen atom, $R^{38}$ is not present. When $Z^{41}$ represents an oxygen atom, $R^{47}$ and $R^{48}$ are not present, and when $Z^{41}$ represents a nitrogen atom, $R^{48}$ is not present. When $Z^{51}$ represents an oxygen atom, $R^{59}$ and $R^{60}$ are not present, and when $Z^{51}$ represents a nitrogen atom, $R^{60}$ is not present.

$$-(\alpha)_l-(\beta)_m-\gamma \quad \text{(A)}$$

In Formula (A), at least one of α, β, and γ represents a group having a substituent selected from the group consisting of a hydroxy group, a thiol group, amino group, a carboxyl group, and a methoxy group. l and m each independently represent 0 or 1, and the sum of l and m is 0 or more and 2 or less.

α represents an alkylene group having 1 to 6 main-chain atoms, a C1-6 alkyl-substituted alkylene group having 1 to 6 main-chain atoms, a benzyl-substituted alkylene group having 1 to 6 main-chain atoms, an alkoxycarbonyl-substituted alkylene group having 1 to 6 main-chain atoms, or a phenyl-substituted alkylene group having 1 to 6 main-chain atoms. Such a group may have at least one substituent selected from the group consisting of a hydroxy group, a thiol group, an amino group, a carboxyl group, and a methoxy group. One $CH_2$ in the main chain of such an alkylene group may be substituted with O, S, or $NR^{122}$ (wherein, $R^{122}$ represents a hydrogen atom or an alkyl group).

β represents a phenylene group, a C1-6 alkyl-substituted phenylene group, a nitro-substituted phenylene group, a halogen-substituted phenylene group, or an alkoxy-substituted phenylene group. Such a group may have at least one substituent selected from the group consisting of a hydroxy group, a thiol group, an amino group, a carboxyl group, and a methoxy group.

γ represents a hydrogen atom, an alkyl group having 1 to 6 main-chain atoms, or a C1-6 alkyl-substituted alkyl group having 1 to 6 main-chain atoms. Such a group may have at least one substituent selected from the group consisting of a hydroxy group, a thiol group, an amino group, a carboxyl group, and a methoxy group. One $CH_2$ in the main chain of such an alkyl group may be substituted with O, S, or $NR^{123}$ (wherein, $R^{123}$ represents a hydrogen atom or an alkyl group).

Specific examples of the compounds represented by Formulae (A1) to (A11) are shown below.

Specific examples of the compound represented by Formula (A1)

| | $R^{11}$~$R^{14}$ | $R^{15}$ | $R^{16}$ |
|---|---|---|---|
| A101 | H | 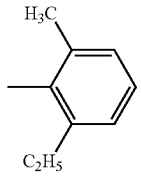 | 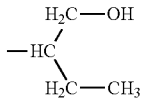 |
| A102 | H | 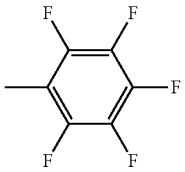 | 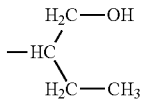 |
| A103 | H | 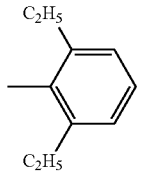 | 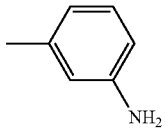 |
| A104 | H | 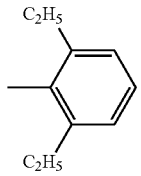 | 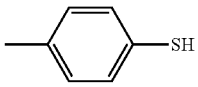 |
| A105 | H | 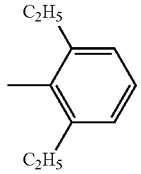 | 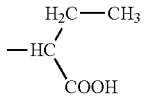 |
| A106 | H | 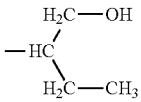 | 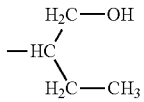 |

-continued
| | $R^{11}$~$R^{14}$ | $R^{15}$ | $R^{16}$ |
|---|---|---|---|
| A107 | H | 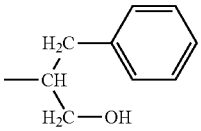 | 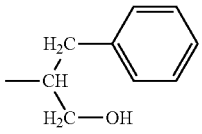 |
| A108 | H | 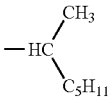 | 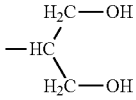 |
| A109 | H | 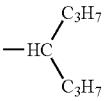 | 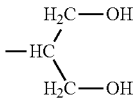 |
| A110 | H | 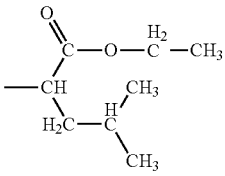 | 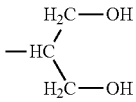 |
| A111 | H | 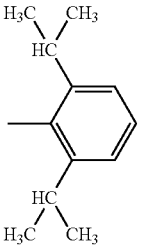 | 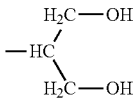 |
| A112 | H | 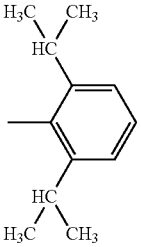 | 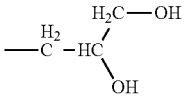 |
| A113 | H | 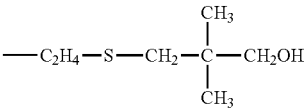 | 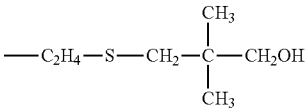 |
| A114 | H | 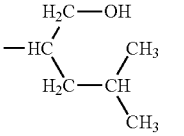 | 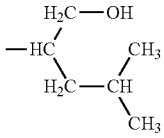 |
| A115 | H | $—C_2H_4—S—C_2H_4—OH$ | 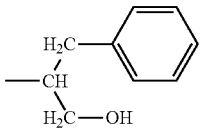 |

-continued
| | $R^{11}$~$R^{14}$ | $R^{15}$ | $R^{16}$ |
|---|---|---|---|
| A116 | H | 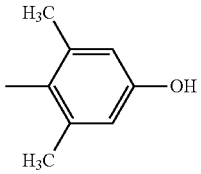 | 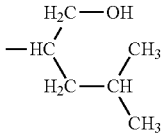 |
| A117 | H | 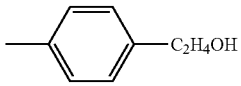 | 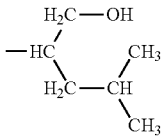 |
| A118 | H | 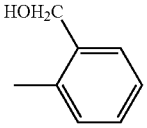 | 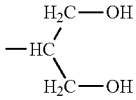 |
| A119 | H | 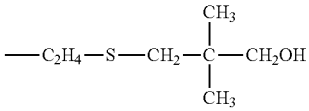 | 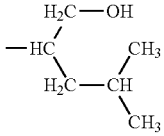 |
| A120 | H | 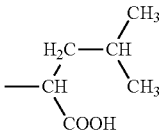 | 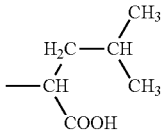 |
Specific examples of the compound represented by Formula (A2)
| | $R^{21}$ | $R^{22}$ | $R^{23}$ | $R^{24}$ | $R^{25}$ |
|---|---|---|---|---|---|
| A201 | H | H | 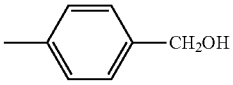 | H | H |
| A202 | H | H | H | H | H |
| A203 | H | H | 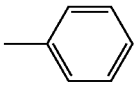 | H | H |
| A204 | H | H | 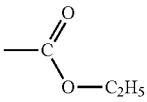 | H | H |
| A205 | H | H | 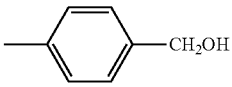 | H | H |
| A206 | H | 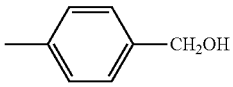 | H | H | H |

-continued
| | $R^{26}$ | $R^{27}$ | $R^{28}$ | $Z^{21}$ | $R^{29}$ |
|---|---|---|---|---|---|
| A201 | H | H | H | O | — |
| A202 | H | H | H | N | 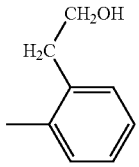 |
| A203 | 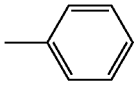 | H | H | N | 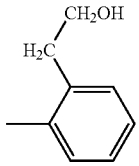 |
| A204 | 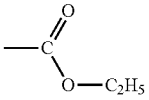 | H | H | N | 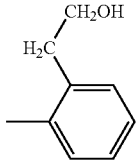 |
| A205 | 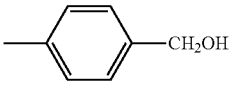 | H | H | O | — |
| A206 | H | 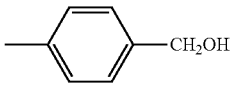 | H | O | — |
Specific examples of the compound represented by Formula (A3)
| | $R^{31}$ | $R^{32}$ | $R^{33}$ | $R^{34}$ | $R^{35}$ | $R^{36}$ | $Z^{31}$ | $R^{37}$ | $R^{38}$ |
|---|---|---|---|---|---|---|---|---|---|
| A301 | H | 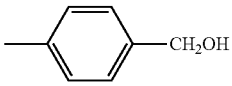 | H | H | H | H | O | — | — |
| A302 | H | H | H | H | H | H | N | 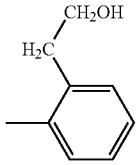 | — |
| A303 | H | H | H | H | H | H | N | 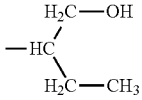 | — |
| A304 | H | H | Cl | Cl | H | H | N | 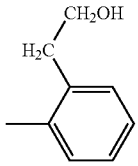 | — |

-continued

| | $R^{31}$ | $R^{32}$ | $R^{33}$ | $R^{34}$ | $R^{35}$ | $R^{36}$ | $Z^{31}$ | $R^{37}$ | $R^{38}$ |
|---|---|---|---|---|---|---|---|---|---|
| A305 | H | 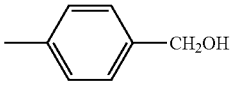 | H | H | 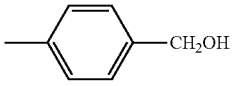 | H | C | CN | CN |

Specific examples of the compound represented by Formula (A4)

| | $R^{41}$ | $R^{42}$ | $R^{43}$ | $R^{44}$ | $R^{45}$ | $R^{46}$ | $Z^{41}$ | $R^{47}$ | $R^{48}$ |
|---|---|---|---|---|---|---|---|---|---|
| A401 | H | H | 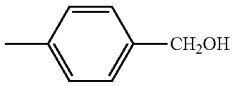 | H | H | H | C | CN | CN |
| A402 | H | H | H | H | H | H | N | 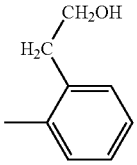 | — |
| A403 | H | H | 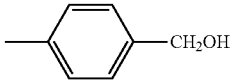 | 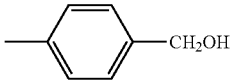 | H | H | C | CN | CN |
| A404 | H | H | 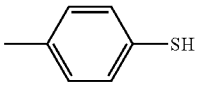 | 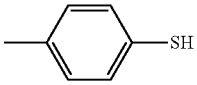 | H | H | C | CN | CN |
| A405 | H | H | 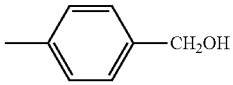 | 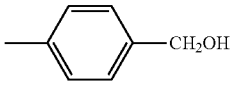 | H | H | O | — | — |

Specific examples of the compound represented by Formula (A5)

| | $R^{51}$ | $R^{52}$ | $R^{53}$ | $R^{54}$ | $R^{55}$ | $R^{56}$ | $R^{57}$ | $R^{58}$ | $Z^{51}$ | $R^{59}$ | $R^{60}$ |
|---|---|---|---|---|---|---|---|---|---|---|---|
| A501 | H | 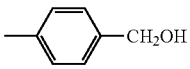 | H | H | H | H | H | H | C | CN | CN |
| A502 | H | $NO_2$ | H | H | $NO_2$ | H | $NO_2$ | H | N | 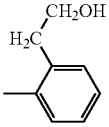 | — |
| A503 | H | $H_2C-OH$<br>$-HC$<br>$H_2C-CH_3$ | H | H | H | H | $H_2C-OH$<br>$-HC$<br>$H_2C-CH_3$ | H | C | CN | CN |
| A504 | H | H | 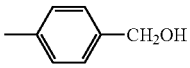 | H | H | 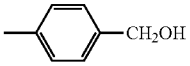 | H | H | C | CN | CN |

Specific examples of the compound represented by Formula (A6)
| | $R^{61}$ | $R^{62}$ | $R^{63}$~$R^{66}$ |
|---|---|---|---|
| A601 | 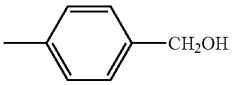 | H | H |
| A602 | 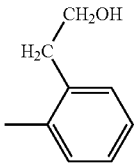 | H | H |
| A603 | 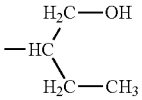 | H | H |
| A604 | 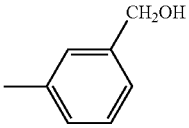 | 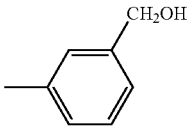 | H |
| A605 | 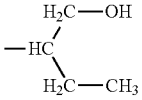 | 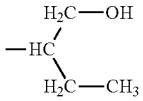 | H |
Specific examples of the compound represented by Formula (A7)
| | $R^{71}$ | $R^{72}$~$R^{74}$ | $R^{75}$ | $R^{76}$~$R^{78}$ |
|---|---|---|---|---|
| A701 | 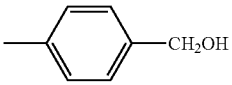 | H | H | H |
| A702 | 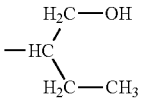 | H | H | H |
| A703 | 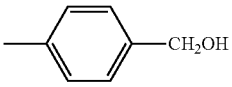 | H | 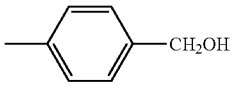 | H |
| A704 | 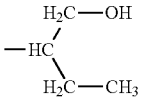 | H | 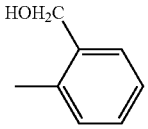 | H |
| A705 | 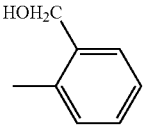 | H | 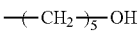 | H |
Specific examples of the compound represented by Formula (A8)
| | $R^{81}$ | $R^{82}$ | $R^{83}$~$R^{86}$ | $R^{87}$ | $R^{88}$ | $R^{89}$ | $R^{90}$ |
|---|---|---|---|---|---|---|---|
| A801 | H | H | H | H | H | 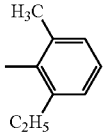 | 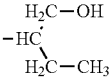 |
| A802 | H | H | H | H | H | 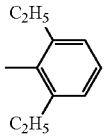 | 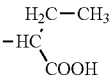 |
| A803 | H | CN | H | CN | H | 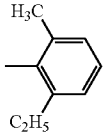 | 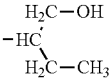 |
| A804 | H | H | H | H | H | 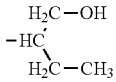 | 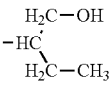 |
| A805 | H | H | H | H | H | 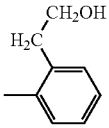 | 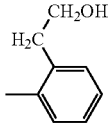 |

Specific examples of the compound represented by Formula (A9)

| | $R^{91}$ | $R^{92}$ | $R^{93}$ | $R^{94}$ | $R^{95}$ | $R^{96}$ | $R^{97}$ | $R^{98}$ |
|---|---|---|---|---|---|---|---|---|
| A901 | $—CH_2—OH$ | H | H | H | H | H | H | H |
| A902 | $—(CH_2)_2—OH$ | H | H | H | H | H | H | H |
| A903 | H | H | H | H | H | H | H | $—CH_2—OH$ |
| A904 | H | H | H | H | H | H | H | $—(CH_2)_2—OH$ |
| A905 | H | CN | H | H | H | H | CN | 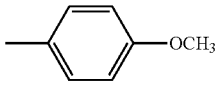 |
| A906 | $—(CH_2)_2—OH$ | $—(CH_2)_2—OH$ | H | $NO_2$ | H | H | $NO_2$ | H |
| A907 | H | $—CH_2—OH$ | $—CH_2—OH$ | H | H | H | H | H |

Specific examples of the compound represented by Formula (A10)

| | $R^{101}$ | $R^{102}$~$R^{104}$ | $R^{105}$ | $R^{106}$~$R^{109}$ | $R^{110}$ |
|---|---|---|---|---|---|
| A1001 | 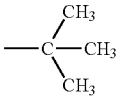 | H | $—CH_2—OH$ | H | 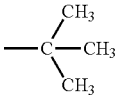 |
| A1002 | 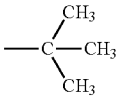 | H | 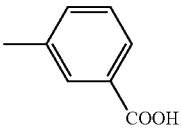 | H | 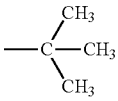 |
| A1003 | 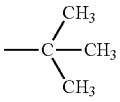 | H | 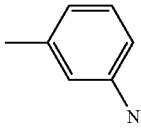 | H | 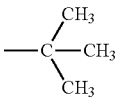 |
| A1004 | 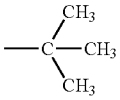 | H | 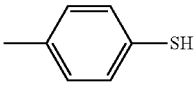 | H | 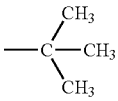 |
| A1005 | 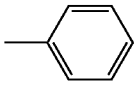 | H | $—CH_2—OH$ | H | 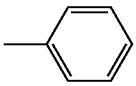 |

Specific examples of the compound represented by Formula (A11)

| | $R^{111}$ | $R^{112}$~$R^{115}$ | $R^{116}$ | $R^{117}$~$R^{120}$ |
|---|---|---|---|---|
| A1101 | 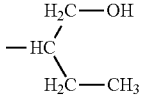 | H | 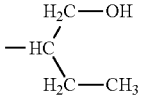 | H |

-continued

| | $R^{111}$ | $R^{112}$~$R^{115}$ | $R^{116}$ | $R^{117}$~$R^{120}$ |
|---|---|---|---|---|
| A1102 | 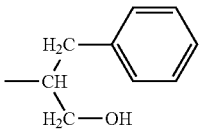 | H | 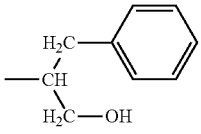 | H |
| A1103 | 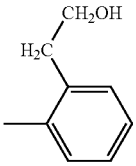 | H | 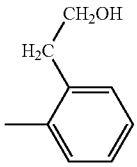 | H |
| A1104 | 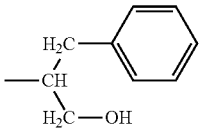 | H | 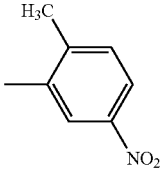 | H |
| A1105 | 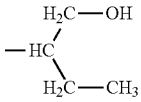 | H | 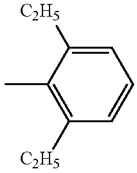 | H |

The compounds represented by Formulae (A1) to (A11) can be prepared by preparing derivatives having the structures represented by Formulae (A1) to (A11) (compounds having halogen atoms instead of the polymerizable functional groups of the compounds represented by Formulae (A1) to (A11)) and substituting the halogen atoms with the polymerizable functional groups (a hydroxy group, a thiol group, an amino group, a carboxyl group, or a methoxy group).

The derivatives having the structures represented by Formulae (A1) to (A11) can be respectively prepared as follows. A derivative having the structure represented by Formula (A1) can be synthesized by a reaction between naphthalenetetracarboxylic dianhydride and a monoamine derivative, available from Tokyo Chemical Industry Co., Ltd. and Johnson Matthey Japan Inc. Derivatives having the structures represented by Formulae (A2) to (A6) and (A9) (derivatives of electron transport materials) can be purchased from Tokyo Chemical Industry Co., Ltd., Sigma-Aldrich Co. LLC., and Johnson Matthey Japan Inc. A derivative having the structure represented by Formula (A7) can be synthesized using a phenol derivative available from Tokyo Chemical Industry Co., Ltd. and Sigma-Aldrich Co. LLC. A derivative having the structure represented by Formula (A8) can be synthesized by a reaction between perylenetetracarboxylic dianhydride and a monoamine derivative, available from Tokyo Chemical Industry Co., Ltd. and Sigma-Aldrich Co. LLC. A derivative having the structure represented by Formula (A10) can be synthesized by oxidizing a phenol derivative having a hydrazone structure with an appropriate oxidizing agent, such as potassium permanganate, in an organic solvent by a known synthetic method (for example, Japanese Patent No. 3717320). A derivative having the structure represented by Formula (A11) can be synthesized by a reaction among naphthalenetetracarboxylic dianhydride, a monoamine derivative, and hydrazine, available from Tokyo Chemical Industry Co., Ltd., Sigma-Aldrich Co. LLC., and Johnson Matthey Japan Inc.

Polymerizable functional groups can be introduced into derivatives having the structures represented by Formulae (A1) to (A11) (hereinafter, also simply referred to as "derivative") by, for example, a cross coupling reaction using a palladium catalyst and a base to introduce an aryl group having a polymerizable functional group; a cross coupling reaction using a $FeCl_3$ catalyst and a base to introduce an alkyl group having a polymerizable functional group; or lithiating a derivative and then acting an epoxy compound or $CO_2$ to the derivative to introduce a hydroxyalkyl group or a carboxyl group.

(2) Crosslinking Agent

The crosslinking agent may be any known material, and examples thereof include compounds described in "Kakyozai Handobukku (Crosslinking agent handbook)" Edited by Shinzo Yamashita and Tosuke Kaneko, Taiseisha Ltd. (1981). In the aspects of the present invention, the crosslinking agent can have a polymerizable functional group.

In the aspects of the present invention, the crosslinking agent can be an isocyanate compound or an amino compound. Each compound will now be described.

(2-1) Isocyanate Compound

In the aspects of the present invention, the isocyanate compound has an isocyanate group, in particular, three to six isocyanate groups in one molecule. Since the reactivity of an isocyanate compound may be difficult to control, the isocyanate group may be protected with a protective group and the resulting blocked isocyanate compound can be added to a coating solution.

The isocyanate group can be protected with a protective group represented by Formulae (H1) to (H6). The isocyanate group protected with such a protective group is in a form of —NHCOX (X represents a protective group).

(H1)

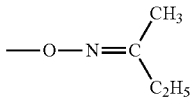

(H2)

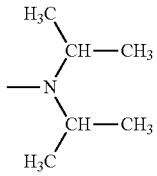

(H3)

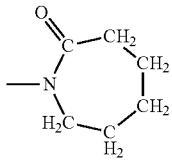

(H4)

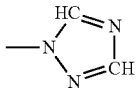

(H5)

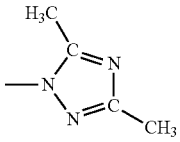

(H6)

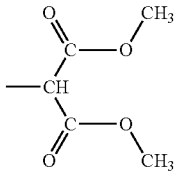

Examples of the isocyanate compound include various modified products, such as isocyanurate modified products, biuret modified products, allophanate modified products, and adduct products with trimethylolpropane or pentaerythritol, specifically, triisocyanatebenzene, triisocyanatemethylbenzene, triphenylmethane triisocyanate, lysine triisocyanate, tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate, and norbornane diisocyanate. Among these modified products, the isocyanurate modified products and the adduct products can be particularly used.

Specific examples of the isocyanate compound, B1 to B21, are shown below.

B1

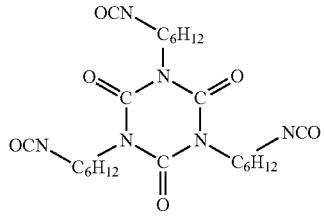

B2

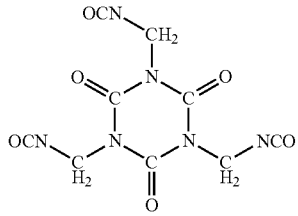

B3

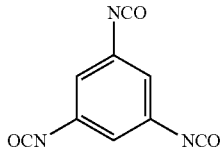

B4

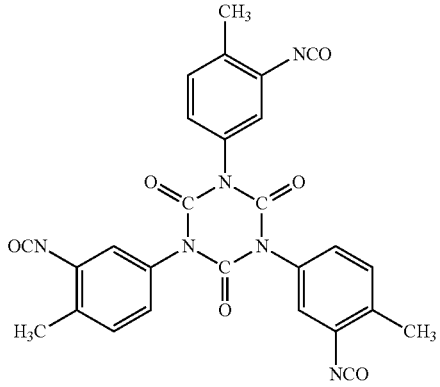

B5

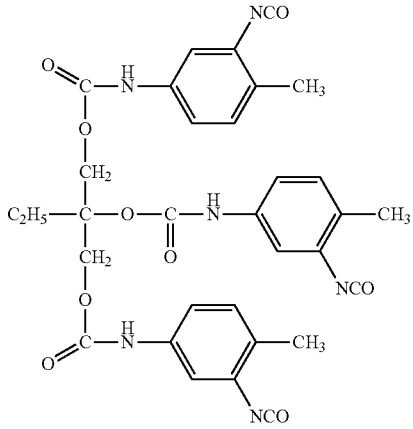

-continued
B6
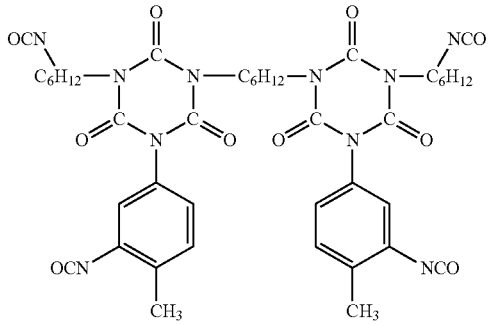
B7
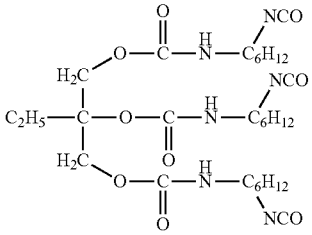
B8
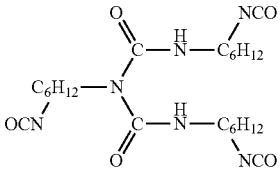
B9
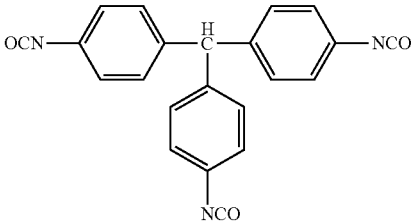
B10
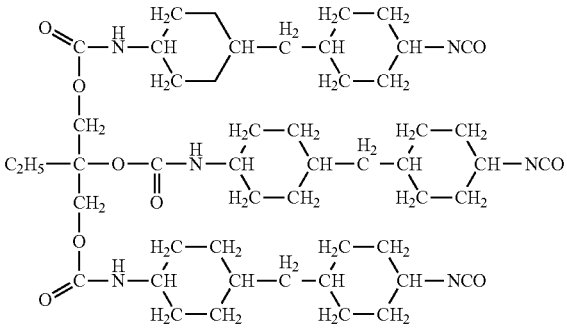
-continued
B11
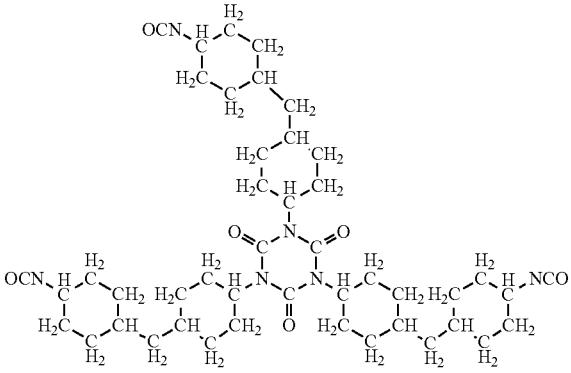
B12
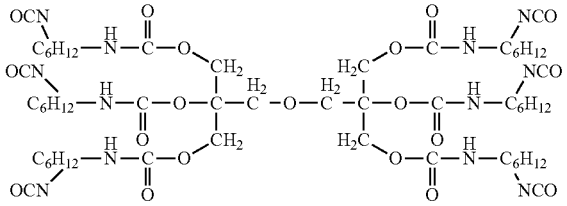
B13
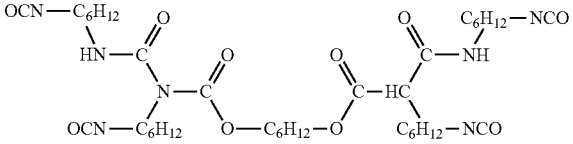
B14
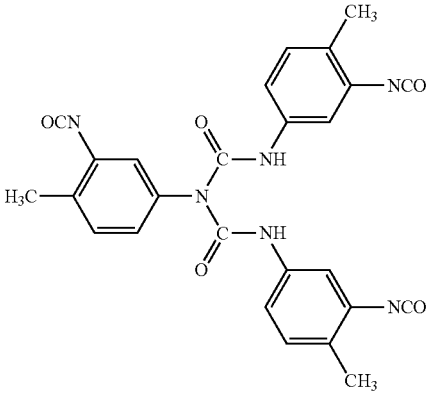

-continued

B15

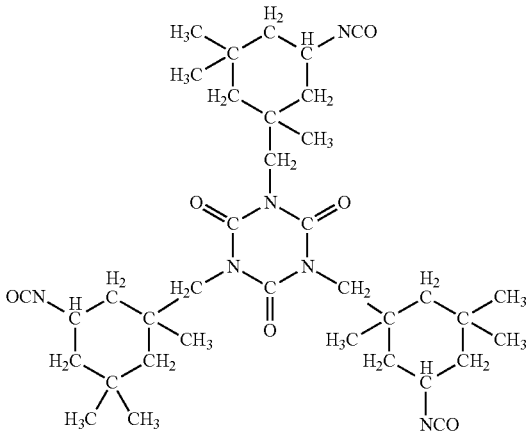

B16

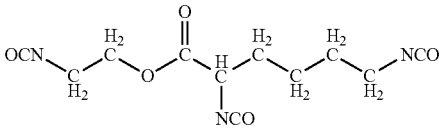

B17

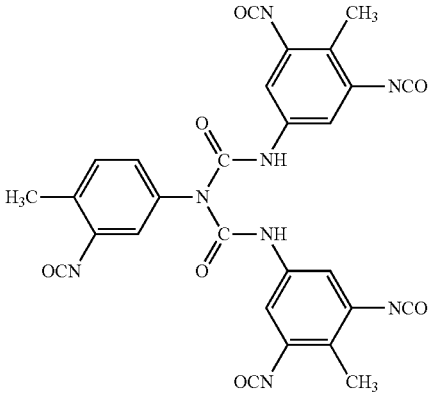

B18

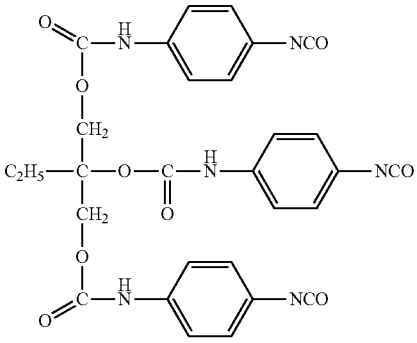

-continued

B19

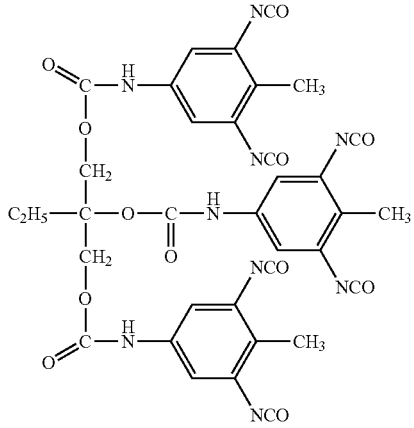

B20

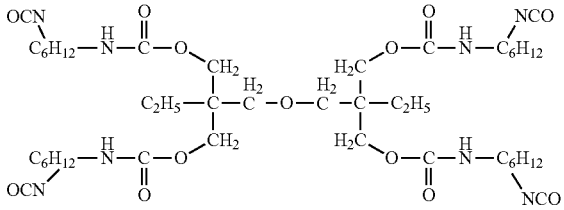

B21

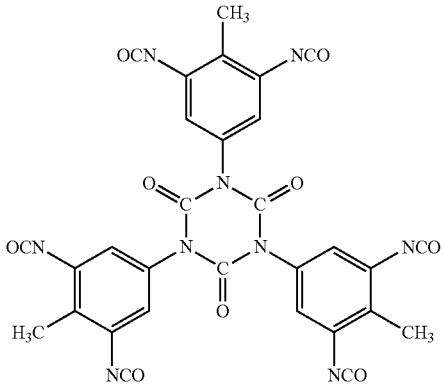

(2-2) Amino Compound

In the aspects of the present invention, the amino compound can have a group represented by —$CH_2$—OH or —$CH_2$—O—$R^1$ ($R^1$ represents an optionally branched C1-10 alkyl group). The amino compound further can be a compound represented by any of Formulae (C1) to (C5). The amino compound can have a molecular weight of 200 or more and 1000 or less for forming a uniform cured film.

(C1)

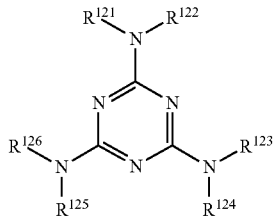

-continued (C2)

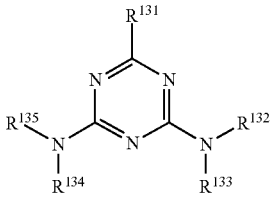

(C3)

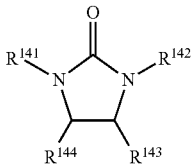

(C4)

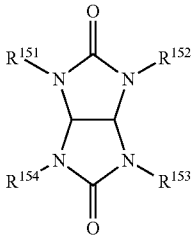

(C5)

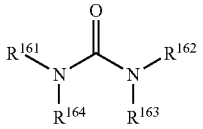

In Formulae (C1) to (C5), $R^{121}$ to $R^{126}$, $R^{133}$ to $R^{135}$, $R^{141}$ to $R^{144}$, $R^{151}$ to $R^{154}$, and $R^{161}$ to $R^{164}$ each independently represent a hydrogen atom, —$CH_2$—OH, or —$CH_2$—O—$R^1$, where $R^1$ represents an optionally branched C1-10 alkyl group. The alkyl group can be a methyl, ethyl, or butyl group from the viewpoint of polymerizability.

Concerning commercially available materials, examples of the compound represented by Formula (C1) include Super Melamine 90 (manufactured by NOF Corporation), Super Beckamine (Registered trademark) series TD-139-60, L-105-60, L127-60, L110-60, J-820-60, and G-821-60 (manufactured by DIC Corporation), Uban 2020 (manufactured by Mitsui Chemicals, Inc.), Sumitec Resin M-3 (manufactured by Sumitomo Chemical Co., Ltd.), and Nikalac series MW-30, MW-390, and MX-750LM (manufactured by Nippon Carbide Industries Co., Ltd.); examples of the compound represented Formula (C2) include Super Beckamine (Registered trademark) series L-148-55, 13-535, L-145-60, and TD-126 (manufactured by DIC Corporation) and Nikalac series BL-60 and BX-4000 (manufactured by Nippon Carbide Industries Co., Ltd.); examples of the compound represented by Formula (C3) include Nikalac MX-280 (manufactured by Nippon Carbide Industries Co., Ltd.); examples of the compound represented by Formula (C4) include Nikalac MX-270 (manufactured by Nippon Carbide Industries Co., Ltd.); and examples of the compound represented by Formula (C5) include Nikalac MX-290 (manufactured by Nippon Carbide Industries Co., Ltd.).

Specific examples of the compounds represented by Formulae (C1) to (C5) are shown below. Although the examples shown below are monomers, the materials may be polymers having these monomers as the structural units. The degree of polymerization of the polymer can be 2 or more and 100 or less. Furthermore, a mixture of two or more of these materials may be used.

Compounds represented by Formula (C1)

C1-1

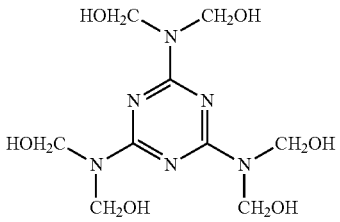

C1-2

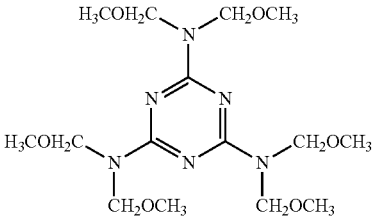

C1-3

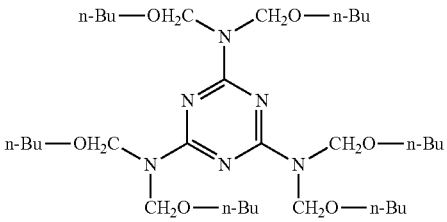

C1-4

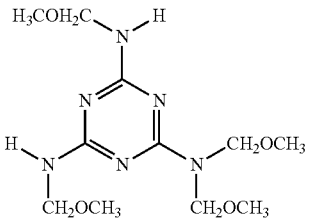

C1-5

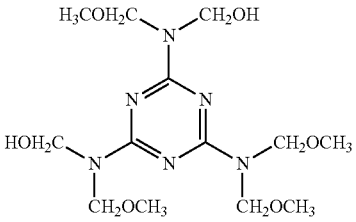

C1-6

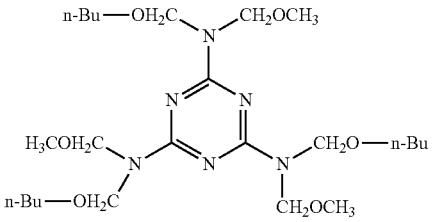

-continued
C1-7
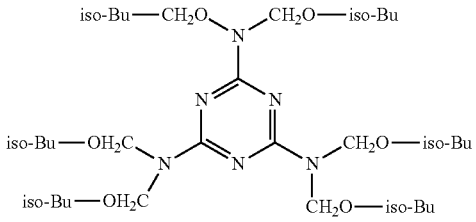
C1-8
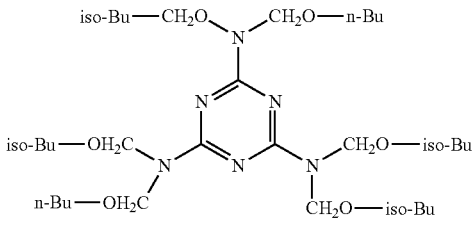
C1-9
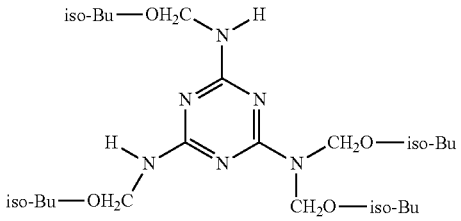
C1-10
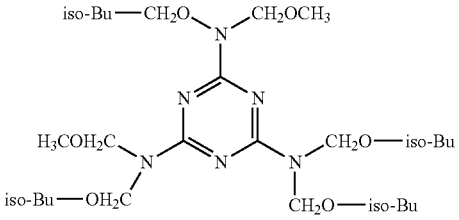
C1-11
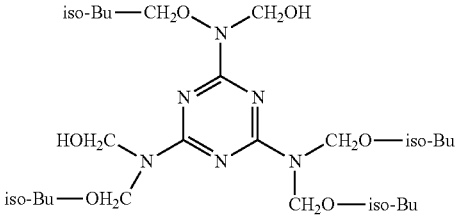
C1-12
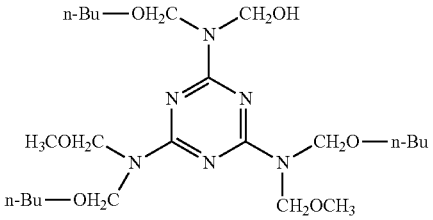
Compounds represented by Formula (C2)
C2-1
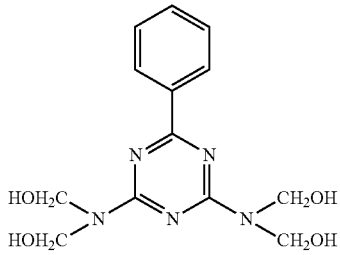
C2-2
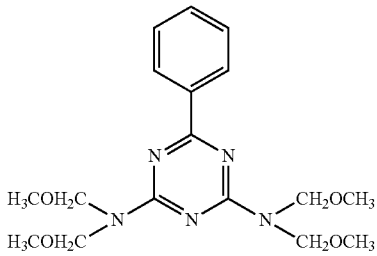
C2-3
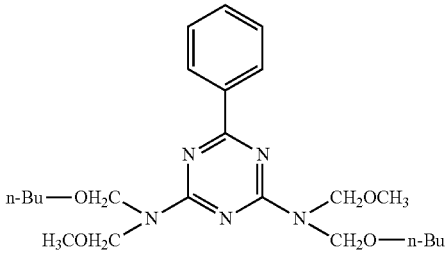
C2-4
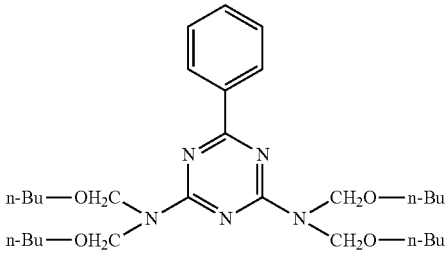
C2-5
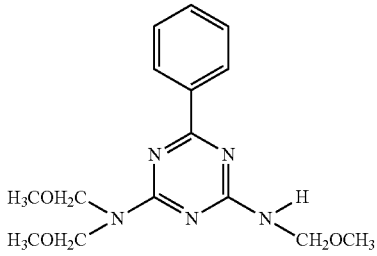
C2-6
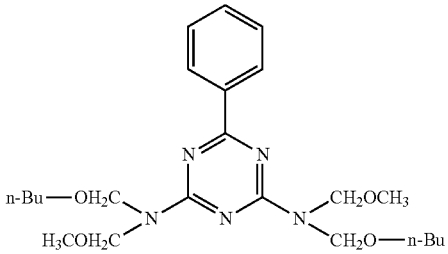

-continued
C2-7
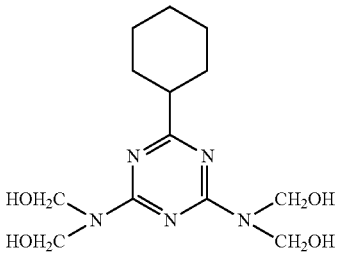
C2-8
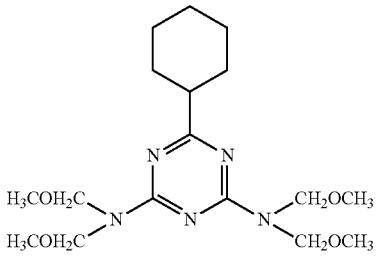
C2-9
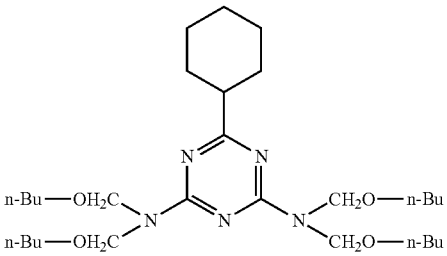
C2-10
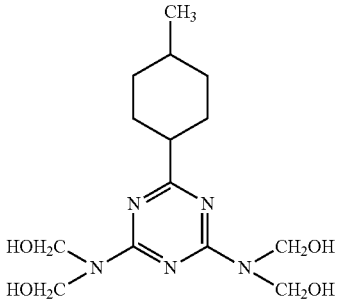
C2-11
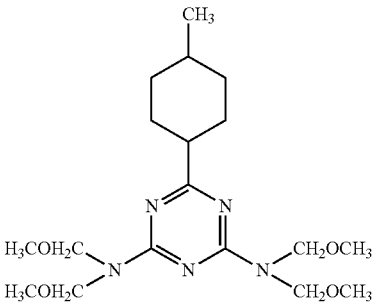
-continued
C2-12
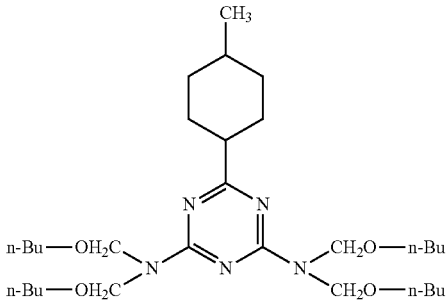
C2-13
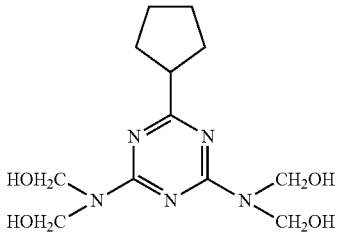
C2-14
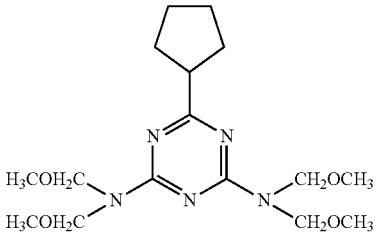
C2-15
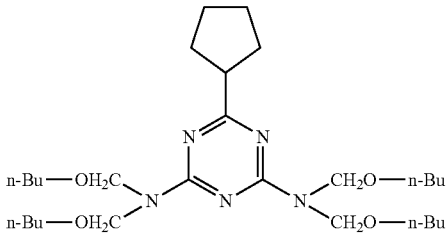
C2-16
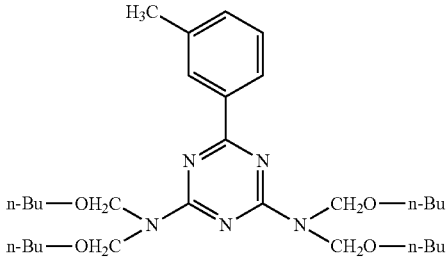
C2-17
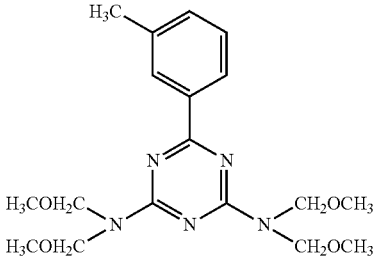

-continued
C2-18
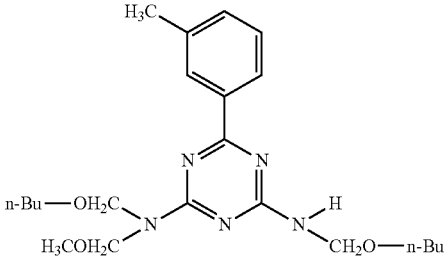
Compounds represented by Formula (C3)
C3-1
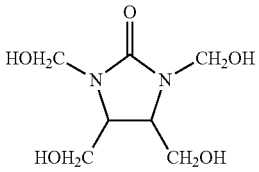
C3-2
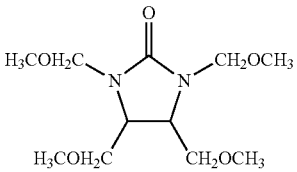
C3-3
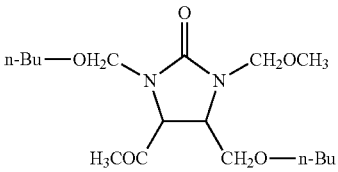
C3-4
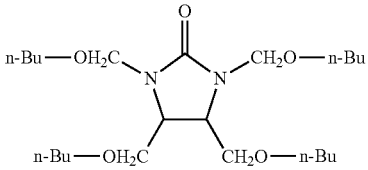
C3-5
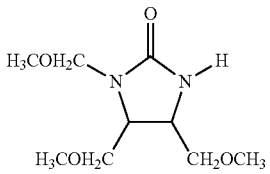
C3-6
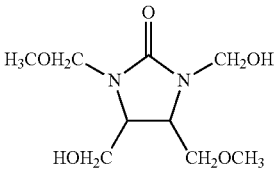
Compounds represented by Formula (C4)
C4-1
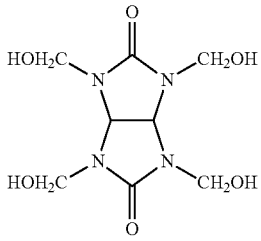
C4-2
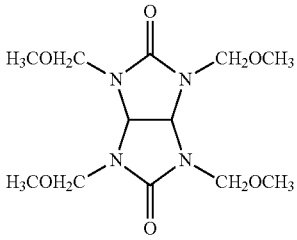
C4-3
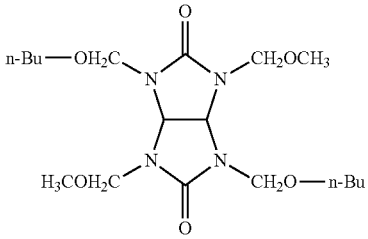
C4-4
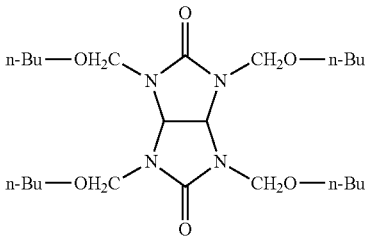
C4-5
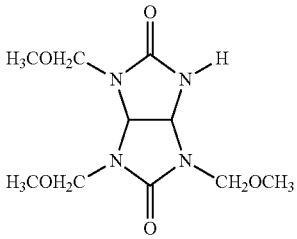
C4-6
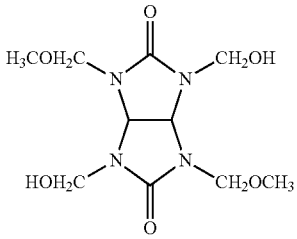

Compounds represented by Formula (C5)

C5-1

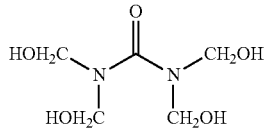

C5-2

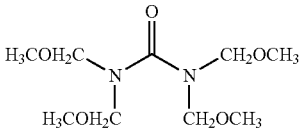

C5-3

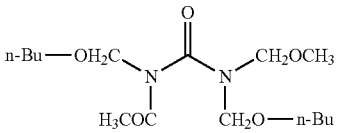

C5-4

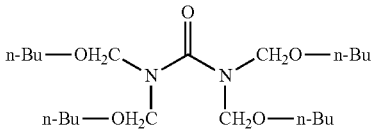

C5-5

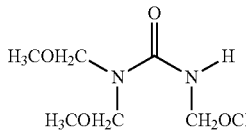

C5-6

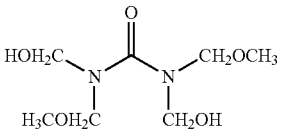

(3) Resin

In the aspects of the present invention, the undercoat layer can contain a polymer of a composition containing an electron transport material, a crosslinking agent, and a resin. The resin can have a weight-average molecular weight of 5000 or more and 400000 or less.

The resin can be a thermoplastic resin, such as a polyacetal resin, a polyolefin resin, a polyester resin, a polyether resin, or a polyamide resin. The resin further can have a polymerizable functional group. Examples of the polymerizable functional group include a hydroxy group, a thiol group, an amino group, a carboxyl group, and a methoxy group. That is, the resin can have a structural unit represented by Formula (D):

(D)

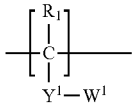

In Formula (D), $R_1$ represents a hydrogen atom or an alkyl group; $Y^1$ represents a single bond, an alkylene group, or a phenylene group; and $W^1$ represents a hydroxy group, a thiol group, an amino group, a carboxyl group, or a methoxy group.

Examples of commercially available thermoplastic resin having a polymerizable functional group include:

polyether polyol resins, such as AQD-457 and AQD-473 (manufactured by Nippon polyurethane Industry Co., Ltd.) and Sannix series GP-400 and GP-700 (manufactured by Sanyo Chemical Co., Ltd.);

polyester polyol resins, such as Phthalkid W2343 (manufactured by Hitachi Chemical Co., Ltd.), Watersol series S-118 and CD-520 and Beckolite series M-6402-50 and M-6201-40IM (manufactured by DIC Corporation), Haridip WH-1188 (manufactured by Harima Chemicals Group, Inc.), and ES3604 and ES6538 (manufactured by Japan Upica Co., Ltd.);

polyacryl polyol resins, such as Burnock series WE-300 and WE-304 (manufactured by DIC Corporation);

polyvinyl alcohol resins, such as Kuraray Poval PVA-203 (manufactured by Kuraray Co., Ltd.);

polyvinyl acetal resins, such as BX-1, BM-1, and KS-5 (manufactured by Sekisui Chemical Co., Ltd.);

polyamide resins, such as Toresin FS-350 (manufactured by Nagase ChemteX Corporation);

carboxyl group-containing resins, such as Aqualic (manufactured by Nippon Shokubai Co., Ltd.) and Finelex SG2000 (manufactured by Namariichi Co., Ltd.);

polyamine resins, such as Rackamide (manufactured by DIC Corporation); and polythiol resins, such as QE-340M (manufactured by Toray Industries, Inc.). Among these resins, polyvinyl acetal resins having polymerizable functional groups and polyester polyol resins having polymerizable functional groups can be particularly used from the viewpoints of polymerizability and uniformity of the resulting undercoat layers.

(Intermediate Layer)

In the electrophotographic photoreceptor of the aspects of the present invention, the second portion includes an intermediate layer having a Martens hardness of 500 N/mm or less:

(i) between and so as to be contiguous with the support and the charge generating layer;

(ii) between and so as to be contiguous with the charge generating layer and the surface layer; or (iii) between and so as to be contiguous with the support and the charge generating layer and between and so as to be contiguous with the charge generating layer and the surface layer.

In the aspects of the present invention, the intermediate layer can have a Martens hardness of 100 $N/mm^2$ or less. In the aspects of the present invention, the Martens hardness of the intermediate layer is measured as follows.

The layers on the surface side than the portion where the intermediate layer is formed are peeled to prepare a photoreceptor having an intermediate layer exposed to the surface. In the peeling, a solvent that does not dissolve the intermediate layer can be used. The Martens hardness of the intermediate layer is measured at arbitrary three points from the upper side of the intermediate layer with a Fischer ultramicro hardness tester (Picodentor HM500, manufactured by Fischer Instruments K.K.) in accordance with ISO14577-1 (2002) under the following measurement conditions. The average is defined as the Martens hardness of the intermediate layer. On this occasion, the photoreceptor and the measuring apparatus are left to stand at 25° C. for 24 hours before the measurement.

Measurement Conditions

Measurement indenter shape: triangular pyramid indenter (edge angle: 115°, Berkovich type)

Measurement indenter material: diamond

Measurement temperature: 25° C.

Loading and unloading rate: 0.1 mN/10 s

Loading time: 5.0 s

In the measurement, the influence of the hardness of the layers formed lower than the intermediate layer is very small, which can be confirmed by the following method: An intermediate layer coating solution is applied to a glass substrate and is dried to form the same layer as the intermediate layer formed on a photoreceptor. The Martens hardness of the formed layer is measured to confirm to have a similar Martens hardness to that of the intermediate layer measured by the above-described method. This is probably because that the displacement accuracy of the measuring apparatus in the measurement is in the order of nanometer or less, which is very small.

The intermediate layer can have an average thickness of 0.1 μm or more and 50 μm or less, more preferably 0.2 μm or more and 40 μm or less.

The surface of the intermediate layer can have a ten-point average roughness $Rz_{JIS}$ (reference length: 0.8 mm) in accordance with JIS B 0601:2001 of 0.5 μm or more and 2.5 μm or less.

In the aspects of the present invention, the intermediate layer can contain a resin. The resin can be at least one selected from the group consisting of urethane resins, amino resins, polyamide resins, and polyacetal resins. The resin can have a glass transition temperature of 100° C. or less.

The urethane resin can be synthesized from an isocyanate compound and a resin having a group that can react with the isocyanate compound. In particular, a urethane resin synthesized from an isocyanate compound having a blocked isocyanate group and a polyacetal resin has satisfactory reactivity. Examples of the isocyanate compound having a blocked isocyanate group include TPA-B80E and SBN-70D (manufactured by Asahi Kasei Chemicals Corporation). The amino resin can be synthesized from a melamine resin and a resin having a group that can react with the melamine compound. In particular, an amino resin synthesized from a methylated melamine or a butylated melamine and an alkyd resin has satisfactory reactivity. Examples of the methylated melamine and butylated melamine include Super Beckamine series (manufactured by DIC Corporation). Examples of the polyamide resin include alcohol-soluble copolymer polyamides and modified polyamides, specifically, Toresin EF-30T (manufactured by Nagase ChemteX Corporation) and Amilan CM8000 (manufactured by Toray Industries, Inc.). Specific examples of the polyacetal resin include BX-1 and BM-1 (manufactured by Sekisui Chemical Co., Ltd.).

In the aspects of the present invention, the intermediate layer may contain a resin other than the above-mentioned urethane resins, amino resins, polyamide resins, and polyacetal resins. Examples of such a resin include polymers and copolymers of vinyl compounds, such as styrene, vinyl acetate, vinyl chloride, acrylate, methacrylate, vinylidene fluoride, and trifluoroethylene; polyvinyl alcohol resins; polycarbonate resins; polyester resins; polysulfone resins; polyphenylene oxide resins; cellulose resins; silicone resins; and epoxy resins.

The intermediate layer may further contain a material in addition to resins. For example, an intermediate layer containing particles of a metal oxide having a hydroxy group can have improved adhesiveness to a contiguous layer. In such a case, the intermediate layer can sufficiently show the effects of the aspects of the present invention even if the Martens hardness is higher than 100 N/mm$^2$ but not higher than 500 N/mm$^2$.

Examples of the metal oxide particles include particles of zinc oxide, white lead, aluminum oxide, indium oxide, silicon oxide, zirconium oxide, tin oxide, titanium oxide, magnesium oxide, antimony oxide, bismuth oxide, indium oxide doped with tin, tin oxide doped with antimony or tantalum, and zirconium oxide. Among these particles, particles of zinc oxide, titanium oxide, or tin oxide can be particularly used.

The metal oxide particles can be dispersed in an intermediate layer coating solution by, for example, a method using a paint shaker, a sand mill, a ball mill, or a liquid collision-type high-speed disperser. The surfaces of the metal oxide particles may be treated with, for example, a silane coupling agent for improving the dispersibility of the metal oxide particles. Furthermore, the metal oxide particles may be doped with another metal or metal oxide for reducing the electrical resistance of the intermediate layer.

The metal oxide particles can have a number-average particle diameter of 30 to 450 nm, more preferably 30 to 250 nm, for preventing occurrence of black spots due to formation of a local conduction path.

The intermediate layer can further contain resin particles having an average particle diameter of 1 μm or more and 5 μm or less. Such a configuration roughens the surface of the intermediate layer and thereby can prevent the interference of light reflected by the surface of the intermediate layer, resulting in prevention of occurrence of interference fringes in the output image. Examples of the resin particles include thermosetting resin particles, such as curable rubber, polyurethane, epoxy resin, alkyd resin, phenolic resin, polyester, silicone resin, and acryl-melamine resin particles. Among these particles, silicone resin particles hardly aggregate and can be particularly used.

The intermediate layer can be formed by preparing an intermediate layer coating solution and applying the solution. The intermediate layer coating solution can contain a solvent together with the materials such as the resin. Examples of the solvent include alcohol solvents, such as methanol, ethanol, and isopropanol; sulfoxide solvents; ketone solvents, such as acetone, methyl ethyl ketone, and cyclohexanone; ether solvents, such as tetrahydrofuran, dioxane, ethylene glycol monomethyl ether, and propylene glycol monomethyl ether; ester solvents, such as methyl acetate and ethyl acetate; and aromatic hydrocarbon solvents, such as toluene and xylene.

<Abutting Member>

In the aspects of the present invention, the abutting member abuts against the surface of the second portion of the electrophotographic photoreceptor. Examples of the abutting member include a spacing member for maintaining the distance between the charging member and the electrophotographic photoreceptor and/or between the developer carrying member and the electrophotographic photoreceptor.

The spacing member is, for example, a cylindrical member having a certain thickness. Examples of the material of the member include polyolefin resins, such as polyethylene; polyester resins, such as polyethylene terephthalate; fluorine resins, such as polytetrafluoroethylene; acetal resins, such as polyoxymethylene; rubbers, such as polyisoprene rubber (natural rubber), polyurethane rubber, chloroprene rubber, acrylonitrile butadiene rubber, silicone rubber, and fluorine rubber; and metals having elasticity, such as aluminum, iron, copper, titanium, and alloys mainly composed of these metals.

Another example of the abutting member in the aspects of the present invention is an end part sealing member abutting against the electrophotographic photoreceptor. The end part sealing member is disposed at each end part in the longitudinal direction of the cleaning blade for preventing the developer from leaking through the gap between the electrophotographic photoreceptor (or cleaning blade) and the cleaning frame. In the case of using the end part sealing member, a carrier is interposed between the member and the electrophotographic photoreceptor to pressurize the electrophotographic photoreceptor, causing a risk of peeling of layers, a situation to be solved by the aspects of the present invention. However, even in such a case, the configuration of the electrophotographic photoreceptor of the aspects of the present invention can prevent such peeling of layers.

[Electrophotographic Apparatus]

The electrophotographic apparatus of the aspects of the present invention includes the electrophotographic photoreceptor and at least one member selected from the charging member and the developer carrying member described above and may further include an exposing unit or a transferring unit.

FIG. 2 schematically illustrates an example of the structure of an electrophotographic apparatus including a process cartridge provided with an electrophotographic photoreceptor.

In FIG. 2, the cylindrical electrophotographic photoreceptor 1 is rotary-driven around the shaft 2 as the rotation center in the direction indicated by the arrow at a predetermined circumferential velocity. The surface (peripheral surface) of the electrophotographic photoreceptor 1, which is rotary-driven, is uniformly charged to a predetermined positive or negative potential with the charging unit 3 (primary charging mechanism, such as a charging roller). Subsequently, the surface is exposed to light (image exposure) 4 emitted from an exposing unit (not shown), such as slit exposure or laser beam scanning exposure. Thus, electrostatic latent images corresponding objective images are serially formed on the surface of the electrophotographic photoreceptor 1.

The electrostatic latent images formed on the surface of the electrophotographic photoreceptor 1 are then developed by the toner contained in the developer of the developing unit 5 into toner images. Subsequently, the toner images formed and supported on the surface of the electrophotographic photoreceptor 1 are serially transferred to a transfer medium (for example, paper) P by a transfer bias from the transferring unit (for example, transfer roller) 6. The transfer medium P is taken out from a transfer medium-supplying unit (not shown) and is fed between the electrophotographic photoreceptor 1 and the transferring unit 6 (abutting portion) in synchronization with the rotation of the electrophotographic photoreceptor 1.

The transfer medium P received the transferred toner image is detached from the surface of the electrophotographic photoreceptor 1, is then introduced into the fixing unit 8 to receive image fixing, and is discharged to the outside of the apparatus as an image-formed product (printed matter or copied matter).

The surface of the electrophotographic photoreceptor 1 after the transfer of the toner images is subjected to removal of the remaining developer (toner) with the cleaning unit (for example, cleaning blade) 7 to clean the surface. Subsequently, the surface is neutralized by pre-exposure (not shown) with a pre-exposing unit (not shown) and is repeatedly used for image formation. When the charging unit 3 is a contact charging unit, such as a charging roller, as shown in FIG. 2, pre-exposure is not essential.

Figure 3:
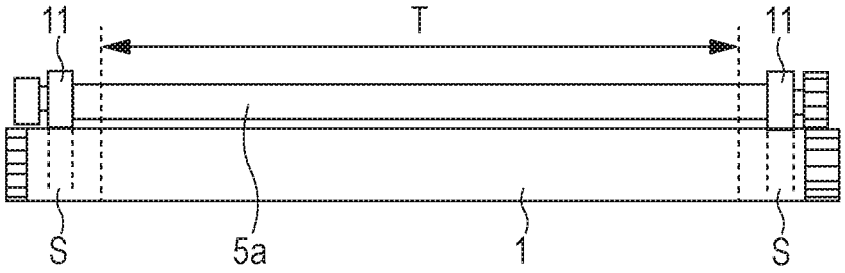
FIG. 3 is a diagram illustrating a relationship between the electrophotographic photoreceptor and the abutting member in the aspects of the present invention.

Two or more components selected from the structural components, such as the electrophotographic photoreceptor 1, the charging unit 3, the developing unit 5, the transferring unit 6, and the cleaning unit 7, may be integrally supported in a container as a process cartridge. The process cartridge may be detachably attached to the main body of an electrophotographic apparatus, such as a copier or a laser beam printer. In FIG. 2, the electrophotographic photoreceptor 1, the charging unit 3, the developing unit 5, and the cleaning unit 7 are integrally supported to constitute a process cartridge 9 that is detachably attachable to the main body of the electrophotographic apparatus with a guiding unit 10, such as rails, of the main body of the electrophotographic apparatus. The abutting member of the aspects of the present invention is attached to the charging unit 3 (charging member) and a developer carrier of the developing unit 5 supplying the developer to the electrophotographic photoreceptor, shown in FIG. 2. FIG. 3 shows a relationship between the charging member or developer carrier and the electrophotographic photoreceptor and the abutting member.

FIG. 3 is an example of a deployment diagram partially illustrating a process cartridge provided with abutting members 11 at the end parts of the charging member or the developer carrier 5*a*. In FIG. 3, the abutting members 11 are cylindrical and are mounted on both end parts in the axial direction of the charging member or the developer carrier 5*a*. The abutting members 11 are in contact with the electrophotographic photoreceptor 1 in the abutting regions (also referred to as projecting areas) S outside the image forming region T. In this configuration, the electrophotographic photoreceptor 1 and the charging member or developer carrier 5*a* are relatively rotatable and are pressed in the direction of approaching each other by a predetermined pressure.

The damage of a photoreceptor receiving the abutting force from the abutting members is large. Accordingly, in order to further realize the effects of the aspects of the present invention, the abutting member abuts against the photoreceptor in the region where the charge generating layer is formed directly on the intermediate layer or the undercoat layer.

Examples of the abutting member include those used for the following purposes: In the case of a contact injection charging system, a space between the brush and the photoreceptor is applied for rubbing the surface of the photoreceptor with, for example, a charging brush. In the case of non-contact charging, a higher runout precision of the outer diameter is used for uniformly charging the photoreceptor by the charging roller. Even in the case of contact charging system, the abutting member may be used for maintaining a certain abutting force against the surface of the photoreceptor. Furthermore, in the case of a contact developing system, the abutting member is used for controlling the contact of the developing roller with the photoreceptor and the inroad amount of the developing roller. In the case of non-contact development, the distance between the developing roller (sleeve) and the photoreceptor is very important, and the abutting member is used for controlling the distance. The abutting member may be also referred to as an inroad amount regulating member.

EXAMPLES

The aspects of the present invention will now be described in more detail by examples and comparative examples, but is not limited to the following examples within the scope of the aspects of the invention. In the following examples, the term "part(s)" is on a mass basis unless otherwise specified.

<1> Production of Electrophotographic Photoreceptor (1) Preparation of Support (Support A)

An aluminum cylinder (JIS-A3003, aluminum alloy) having a length of 260.5 mm and a diameter of 30 mm was used as conductive support A.

(Support B)

An aluminum cylinder (JIS-A3003, aluminum alloy) having a length of 261.6 mm and a diameter of 24 mm was used conductive support B.

(Support C)

Support A was mounted on a lathe and was cut with a sintered diamond bite to obtain an outer diameter of 30.0±0.02 mm, a runout precision of 15 μm, and a surface ten-point average roughness Rz of 0.2 μm. On this occasion, the rotation velocity of the main shaft was 3000 rpm, the feed rate of the bite was 0.3 mm/rev, and the machining time excluding the time for mounting and unmounting the work piece was 24 seconds. The resulting cut aluminum tube was subjected to liquid honing with a liquid (wet) honing machine (manufactured by Fujiseiki Corporation) under the following liquid honing conditions. The processed support had a surface roughness Rz of 0.32 μm.

Liquid Honing Conditions

Polishing abrasive grain: spherical alumina beads (CB-A30S, manufactured by Showa Denko K.K., average particle diameter: 30 μm), Suspension medium: water, Polishing material/suspension medium: 1/9 (volume ratio), Rotation velocity of cut aluminum tube: 1.67 $s^{-}$, Air-blowing pressure: 0.05 MPa, Gun moving speed: 20.0 mm/sec, Distance between gun nozzle and aluminum tube: 150 mm, Honing abrasive grain discharging angle: 600, and Number of times of projection of polishing liquid: one time (one way).

(2) Preparation of Conductive Layer Coating Solution

Metal oxide particles (titanium oxide particles coated with oxygen-deficient tin oxide, 214 parts), a binder resin (phenolic resin, Plyophen J-325, manufactured by Dainippon Ink & Chemicals, Inc., 132 parts), methanol (40 parts), and 1-methoxy-2-propanol (58 parts) were put in a sand mill using glass beads (450 parts, diameter: 0.8 mm) and were dispersed under conditions of a rotation velocity of 2000 rpm, a dispersion time of 4.5 hours, and a cooling water temperature of 18° C. to prepare a dispersion solution. The glass beads were removed from the dispersion solution with a mesh (opening: 150 μm). A surface roughening material (silicone resin particles, Tospearl 120, manufactured by Momentive Performance Materials Inc.) was added to the dispersion solution in an amount of 10% by mass based on the total mass of the metal oxide particles and the binder resin in the dispersion solution. A leveling agent (silicone oil, SH28PA, manufactured by Dow Corning Toray Co., Ltd.) was further added to the dispersion solution in an amount of 0.01% by mass based on the total mass of the metal oxide particles and the binder resin in the dispersion solution. The dispersion solution was stirred to prepare a conductive layer coating solution.

(3) Preparation of Intermediate Layer Coating Solution (Intermediate Layer Coating Solution A)

Zinc oxide particles having an average particle diameter of 70 nm and a specific surface area of 15 $m^2/g$ (manufactured by Tayca Corporation, 1000 parts) were mixed with toluene (5000 parts) by stirring. N-2-(Aminoethyl)-3-aminopropyl-methyldimethoxysilane (KBM602, manufactured by Shin-Etsu Chemical Co., Ltd., 12.5 parts) was further added to the mixture, followed by stirring for 2 hours. The toluene was then distilled under reduced pressure, followed by baking at 120° C. for 3 hours to give surface-treated zinc oxide particles.

A polyvinyl acetal resin (BM-1, manufactured by Sekisui Chemical Co., Ltd., 150 parts) and blocked isocyanate (Sumidur 3175, manufactured by Sumika Bayer Urethane Co., Ltd., 135 parts) were dissolved in methyl ethyl ketone (1600 parts).

To the resulting solution were added the surface-treated zinc oxide particles (100 parts) and benzophenone (6 parts). The mixture was subjected to dispersion with a sand mill using glass beads (diameter: 1 mm) under an atmosphere of 23±3° C. for 3 hours. After the dispersion, silicone resin particles (Tospearl 145, manufactured by Momentive Performance Materials Inc., 10 parts) and a silicone oil (1.2 parts) were added to the dispersion solution, followed by stirring to prepare intermediate layer coating solution A.

(Intermediate layer coating solution B)

A polyvinyl acetal resin (BM-1, manufactured by Sekisui Chemical Co., Ltd., 60 parts) and blocked isocyanate (Sumidur 3175, manufactured by Sumika Bayer Urethane Co., Ltd., 54 parts) were dissolved in methyl ethyl ketone (1600 parts).

To the resulting solution were added the surface-treated zinc oxide particles (300 parts) and benzophenone (6 parts), which were the same as those used in intermediate layer coating solution A. The mixture was subjected to dispersion with a sand mill using glass beads (diameter: 1 mm) under an atmosphere of 23±3° C. for 3 hours. After the dispersion, silicone resin particles (Tospearl 145, manufactured by Momentive Performance Materials Inc., 10 parts) and a silicone oil (1.2 parts) were added to the dispersion solution, followed by stirring to prepare intermediate layer coating solution B.

(Intermediate Layer Coating Solution C)

An alkyd resin (Beckosol 1307-60-EL, manufactured by Dainippon Ink & Chemicals, Inc., 108 parts), an amine resin (Super Beckamine G-821-60, manufactured by Dainippon Ink & Chemicals, Inc., 72 parts), titanium oxide (CR-EL, manufactured by Ishihara Sangyo Kaisha, Ltd., 180 parts), methyl ethyl ketone (1800 parts), and cyclohexanone (450 parts) were mixed by stirring to prepare a uniform slurry. The slurry was then subjected to dispersion with a sand mill using glass beads (diameter: 0.8 mm) under an atmosphere of 25° C. for 5 hours to prepare intermediate layer coating solution C.

(Intermediate Layer Coating Solution D)

Intermediate layer coating solution D was prepared as in the preparation of intermediate layer coating solution C, except that the amounts of the alkyd resin, the amino resin, and the titanium oxide were changed to 48 parts, 32 parts, and 280 parts, respectively.

(Intermediate Layer Coating Solution E)

Intermediate layer coating solution E was prepared as in the preparation of intermediate layer coating solution A, except that the amount (100 parts) of the surface-treated zinc oxide particles was changed to 150 parts.

(Intermediate Layer Coating Solution F)

Intermediate layer coating solution F was prepared as in the preparation of intermediate layer coating solution B, except that the amount (300 parts) of the surface-treated zinc oxide particles was changed to 280 parts.

(Intermediate Layer Coating Solution G)

Intermediate layer coating solution G was prepared as in the preparation of intermediate layer coating solution C, except that the amounts of the alkyd resin, the amino resin, and the titanium oxide were changed to 84 parts, 56 parts, and 210 parts, respectively.

(Intermediate Layer Coating Solution H)

Intermediate layer coating solution H was prepared as in the preparation of intermediate layer coating solution C, except that the amounts of the alkyd resin, the amino resin, and the titanium oxide were changed to 48 parts, 32 parts, and 240 parts, respectively.

(Intermediate Layer Coating Solution I)

Intermediate layer coating solution I was prepared as in the preparation of intermediate layer coating solution A, except that the amount (100 parts) of the surface-treated zinc oxide particles was changed to 30 parts.

(Intermediate Layer Coating Solution J)

Intermediate layer coating solution J was prepared by dissolving polycarbonate diol (Benebiol, manufactured by Mitsubishi Chemical Corporation, 6 parts) and hexamethylene diisocyanate (manufactured by Tokyo Chemical Industry Co., Ltd., 12 parts) in tetrahydrofuran (50 parts).

(Intermediate Layer Coating Solution K)

Intermediate layer coating solution K was prepared by dissolving a polyvinyl acetal resin (BM-1, manufactured by Sekisui Chemical Co., Ltd., 150 parts) and blocked isocyanate (Sumidur 3175, manufactured by Sumika Bayer Urethane Co., Ltd., 135 parts) in methyl ethyl ketone (2200 parts).

(Intermediate Layer Coating Solution L)

Intermediate layer coating solution L was prepared by mixing an alkyd resin (Beckosol 1307-60-EL, manufactured by Dainippon Ink & Chemicals, Inc., 108 parts), an amine resin (Super Beckamine G-821-60, manufactured by Dainippon Ink & Chemicals, Inc., 72 parts), methyl ethyl ketone (1800 parts), and cyclohexanone (450 parts).

(Intermediate Layer Coating Solution M)

N-Methoxymethylated nylon (Toresin EF-30T, manufactured by Nagase ChemteX Corporation, glass transition temperature: 10° C., 6 parts) was mixed with and dissolved in a solvent mixture of methanol (45 parts) and n-butanol (10 parts) to prepare intermediate layer coating solution M.

(Intermediate Layer Coating Solution N)

A polyacetal resin (BM-1, manufactured by Sekisui Chemical Co., Ltd., glass transition temperature: 67° C., 10 parts) was mixed with and dissolved in a solvent mixture of methyl ethyl ketone (45 parts) and n-butanol (100 parts) to prepare intermediate layer coating solution N.

(Intermediate Layer Coating Solution O)

Intermediate layer coating solution O was prepared as in the preparation of intermediate layer coating solution C, except that the amounts of the alkyd resin, the amino resin, and the titanium oxide were changed to 48 parts, 32 parts, and 350 parts, respectively.

(Intermediate Layer Coating Solution P)

A polyamide resin (Amilan CM8000, manufactured by Toray Industries, Inc., glass transition temperature: 40° C., 15 parts) and N-methoxymethylated nylon (Toresin EF-30T, manufactured by Nagase ChemteX Corporation, 35 parts) were mixed with and dissolved in a solvent mixture of methanol (600 parts) and n-butanol (400 parts) to prepare intermediate layer coating solution P.

(Intermediate Layer Coating Solution Q)

A polyamide resin (Amilan CM8000, manufactured by Toray Industries, Inc., 50 parts) was mixed with and dissolved in a solvent mixture of methanol (600 parts) and n-butanol (400 parts) to prepare intermediate layer coating solution Q.

(Intermediate Layer Coating Solution R)

N-Methoxymethylated nylon (Toresin EF-30T, manufactured by Nagase ChemteX Corporation, 50 parts) was mixed with and dissolved in a solvent mixture of methanol (400 parts) and n-butanol (200 parts) to prepare intermediate layer coating solution R.

(Intermediate Layer Coating Solution S)

A polyvinyl alcohol resin (PVA500, manufactured by Kishida Chemical Co., Ltd., glass transition temperature: 85° C., 10 parts) was mixed with and dissolved in a solvent mixture of methanol (120 parts) and pure water (80 parts) with heating at 40° C. to prepare intermediate layer coating solution S.

(Intermediate Layer Coating Solution T)

A polycarbonate resin (Iupilon Z400, manufactured by Mitsubishi Gas Chemical Company, glass transition temperature: 140° C., 5 parts) was mixed with and dissolved in a solvent mixture of O-xylene (120 parts) and THF (80 parts) to prepare intermediate layer coating solution T.

(Intermediate Layer Coating Solution U)

N-Methoxymethylated nylon (Toresin EF-30T, manufactured by Nagase ChemteX Corporation, 50 parts) was mixed with and dissolved in a solvent mixture of methanol (500 parts) and tetrahydrofuran (500 parts) to prepare intermediate layer coating solution U.

TABLE 1

Production conditions of intermediate layer coating solution

| Intermediate layer coating solution | Metal oxide particle | | Resin | |
|---|---|---|---|---|
| | Type | Amount | Type | Amount (part) |
| Coating solution A | Zinc oxide particle | 100 | Urethane resin | 285 |
| Coating solution B | Zinc oxide particle | 300 | Urethane resin | 114 |
| Coating solution C | Zinc oxide particle | 180 | Melamine resin | 180 |
| Coating solution D | Zinc oxide particle | 280 | Melamine resin | 80 |
| Coating solution E | Zinc oxide particle | 150 | Urethane resin | 285 |
| Coating solution F | Zinc oxide particle | 280 | Urethane resin | 114 |
| Coating solution G | Zinc oxide particle | 210 | Melamine resin | 140 |
| Coating solution H | Zinc oxide particle | 240 | Melamine resin | 80 |
| Coating solution I | Zinc oxide particle | 30 | Urethane resin | 285 |
| Coating solution J | — | 0 | Urethane resin | 18 |
| Coating solution K | — | 0 | Urethane resin | 285 |
| Coating solution L | — | 0 | Melamine resin | 180 |
| Coating solution M | — | 0 | N-methoxymethylated nylon | 6 |
| Coating solution N | — | 0 | Polyacetal resin | 10 |
| Coating solution O | Zinc oxide particle | 350 | Melamine resin | 80 |
| Coating solution P | — | 0 | Polyamide resin/N-methoxymethylated nylon | 15/35 |
| Coating solution Q | — | 0 | Polyamide resin | 50 |
| Coating solution R | — | 0 | N-methoxymethylated nylon | 50 |
| Coating solution S | — | 0 | Polyvinyl alcohol resin | 10 |

TABLE 1-continued

| Production conditions of intermediate layer coating solution | | | | |
|---|---|---|---|---|
| | | | Resin | |
| Intermediate layer coating solution | Metal oxide particle Type | Metal oxide particle Amount | Resin Type | Resin Amount (part) |
| Coating solution T | — | 0 | Polycarbonate resin | 5 |
| Coating solution U | — | 0 | N-methoxymethylated nylon | 50 |

* Coating solutions R and U are different from each other in the type of the solvent.

(4) Preparation of Undercoat Layer Coating Solution

An electron transport material, a crosslinking agent, and a resin (the types and the amounts (parts) thereof are shown in Table 2) were dissolved in a solvent mixture of tetrahydrofuran (50 parts) and 1-methoxy-2-propanol (50 parts), together with a catalyst (zinc (II) hexanoate, manufactured by Mitsuwa Chemicals Co., Ltd., 0.05 parts), followed by stirring to prepare each undercoat layer coating solution. In Table 2, resin D1 is a polyvinyl butyral resin (weight-average molecular weight: 340000) containing 2.5 mmol/g of hydroxy groups; resin D2 is a polyester resin (weight-average molecular weight: 10000) containing 2.1 mmol/g of hydroxy groups; resin D3 is a polyolefin resin (weight-average molecular weight: 7000) containing 2.8 mmol/g of methoxy groups; and resin D4 is a polyvinyl butyral resin (weight-average molecular weight: 40000) containing 3.3 mmol/g of hydroxy groups.

TABLE 2

| Production conditions of undercoat layer coating solution | | | | | | |
|---|---|---|---|---|---|---|
| | Electron transport material | | Crosslinking agent | | Resin | |
| Undercoat layer coating solution | Type | Amount (part) | Type* | Amount (part) | Type | Amount (part) |
| Coating solution a | A117 | 4.5 | B1(H5) | 5.5 | D1 | 0.3 |
| Coating solution b | A802 | 5.0 | B1(H1) | 5.0 | — | 0 |
| Coating solution c | A802 | 5.0 | B1(H5) | 5.0 | — | 0 |
| Coating solution d | A101 | 4.0 | C1-3 | 5.5 | D2 | 0.3 |
| Coating solution e | A302 | 4.5 | B1(H1) | 5.5 | D1 | 0.3 |
| Coating solution f | A1003 | 5.0 | B1(H5) | 5.0 | — | 0 |
| Coating solution g | A101 | 4.0 | B1(H5) | 5.5 | D1 | 0.3 |
| Coating solution h | A101 | 4.0 | B1(H5) | 5.5 | — | 0 |
| Coating solution i | A101 | 5.0 | B1(H1) | 4.5 | D1 | 0.5 |
| Coating solution j | A117 | 5.0 | B1(H5) | 5.0 | — | 0 |
| Coating solution k | A101 | 5.0 | B7(H5) | 5.0 | — | 0 |
| Coating solution l | A203 | 4.5 | B1(H5) | 5.5 | D1 | 0.3 |
| Coating solution m | A502 | 5.0 | B1(H5) | 5.0 | — | 0 |
| Coating solution n | A704 | 4.0 | B1(H5) | 5.5 | D1 | 0.3 |
| Coating solution o | A117 | 4.5 | C2-4 | 5.5 | D3 | 0.3 |
| Coating solution p | A302 | 5.0 | C1-7 | 4.5 | D4 | 0.5 |
| Coating solution q | A117 | 4.5 | B15(H1) | 5.5 | D1 | 0.3 |
| Coating solution r | A302 | 4.5 | B1(H5) | 5.5 | D2 | 0.3 |
| Coating solution s | A117 | 4.0 | B1(H5) | 5.5 | — | 0 |

*The expression in parentheses shows the type of the protective group. For example, B1 (H5) means B1 protected with H5.

(5) Preparation of Charge Generating Layer Coating Solution

A charge generation material (hydroxy gallium phthalocyanine crystal showing a pattern having peaks at Bragg angles (2θ±0.2°) of 7.5°, 9.9°, 12.5°, 16.3°, 18.6°, 25.1°, and 28.3° in an X-ray diffraction using Cu-Kα radiation, 10 parts), a polyacetal resin (S-LEC BX-1, manufactured by Sekisui Chemical Co., Ltd., 5 parts), and cyclohexanone (250 parts) were put in a sand mill using glass beads (diameter: 1 mm) and were dispersed for 1.5 hours. Ethyl acetate (250 parts) was added to the resulting dispersion to prepare a charge generating layer coating solution.

(6) Surface Layer Coating Solution

A charge transport material (amine compound represented by the following formula:

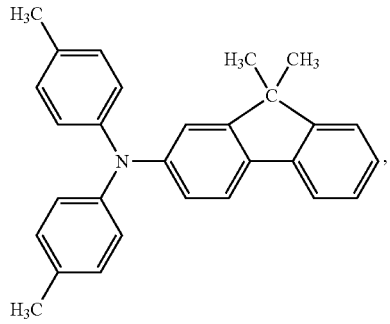

7 parts) and a polyester resin having two structural units represented by the following formulae:

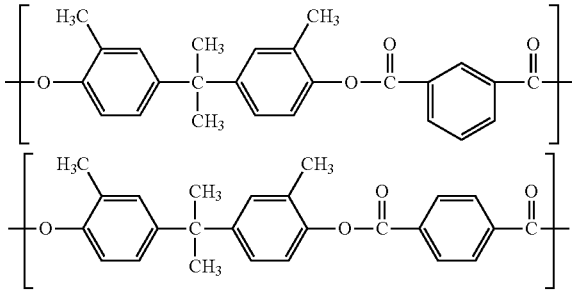

at a molar ratio of 5:5 (weight-average molecular weight: 120000, 10 parts) were dissolved in a solvent mixture of dimethoxymethane (50 parts) and O-xylene (50 parts) to prepare a surface layer coating solution.

(7) Preparation of Electrophotographic Photoreceptor

Electrophotographic photoreceptors were produced by the following processes. Each of the resulting photoreceptors was further subjected to measurements of the average thickness of each layer, the Martens hardness of the intermediate layer, and the area rate of the undercoat layer in the contact area with the abutting member (the total area of the undercoat layer present in the region that can be in contact with the abutting member/the total area of the region that can be in contact with the abutting member) by the methods described above. Each table as shown below shows the types of the support and the coating solution and the physical properties.

(7-1) Production of Electrophotographic Photoreceptor 1-1 to 1-94 (FIG. 1A-1)

(Production of Electrophotographic Photoreceptors 1-1 to 1-92)

A conductive layer coating solution was applied to a support by dip coating. The resulting coating film was dried and heat-cured at 150° C. for 30 minutes to form a conductive layer (in photoreceptors 1-85 and 1-86, no conductive layer was formed). In the dip coating, the conductive layer coating solution was not applied to the region of 2 mm from one end (the upper part in the dip coating) of the support.

The coating solution in the region of 2 mm from the other end (the lower part in the dip coating) was wiped away after the dip coating.

Subsequently, an undercoat layer coating solution was applied to the support provided with the conductive layer (or a support in photoreceptors 1-85 and 1-86) by dip coating. The resulting coating film was heated at 160° C. for 60 minutes for polymerization to form an undercoat layer. In photoreceptors 1-1 to 1-86 and 1-92, in the dip coating, the undercoat layer coating solution was not applied to the region of 15 mm from one end (the upper part in the dip coating) of the support. The undercoat layer in the region of 15 mm from the other end (the lower part in the dip coating) was partially or completely removed after the dip coating by wetting with a cyclohexanone solvent and rubbing with a rubber blade. In photoreceptors 1-87 to 1-91, the undercoat layer was formed by dip coating in the region excluding the region of 3 mm from one end (the upper part in the dip coating) and the region of 3 mm from the other end (the lower part in the dip coating) of the support.

Subsequently, (i) in photoreceptors 1-1 to 1-44 and 1-87 to 1-91, an intermediate layer coating solution was applied to the region of 15 mm from one end (the lower part in the dip coating) of the support by dip coating, and the resulting coating film was dried and heat-cured at 170° C. for 60 minutes (in photoreceptors 1-35 to 1-44, at 70° C. for 6 minutes) to form an intermediate layer only at the lower end part (drying and heat-curing/only lower end part);

(ii) in photoreceptors 1-45 to 1-77, 1-85, and 1-86, an intermediate layer coating solution was applied to the region of 15 mm from one end of the support and the region of 15 mm from the other end of the support by dip coating, and the resulting coating film was air-dried at room temperature for 2 minutes to form intermediate layers at both end parts (air drying/both end parts);

(iii) in photoreceptors 1-78 to 1-84, an intermediate layer coating solution was applied to the region of 15 mm from one end (the lower part in the dip coating) of the support by dip coating, and the resulting coating film was air-dried at room temperature for 2 minutes to form an intermediate layer only at the lower part (air drying/only lower end part); and (iv) in photoreceptor 1-92, an intermediate layer coating solution was applied to the region of 17 mm from one end (the lower part in the dip coating) of the support by dip coating, and the resulting coating film was air-dried at room temperature for 2 minutes to form an intermediate layer only at the lower end part (air drying/only lower end part).

The resulting intermediate layers were each subjected to measurement of ten-point average roughness $Rz_{JIS}$(reference length: 0.8 mm) at positions of 130 mm from one end of the support with a surface roughness measuring meter (Surfcorder SE-3400, manufactured by Kosaka Laboratory Ltd.).

A charge generating layer coating solution was applied to the support provided with the intermediate layer and the undercoat layer by dip coating. The resulting coating film was dried at 100° C. for 10 minutes to form a charge generating layer. In this dip coating, the charge generating layer coating solution was not applied to the region of 3 mm from one end (the upper part in the dip coating) of the support. The coating solution in the region of 3 mm from the other end (the lower part in the dip coating) was wiped away after the dip coating.

Lastly, a surface layer coating solution was applied to the support provided with the intermediate layer, the undercoat layer, and the charge generating layer by dip coating. The resulting coating film was dried at 120° C. for 20 minutes to form a surface layer. In this dip coating, the surface layer coating solution was not applied to the region of 3 mm from one end (the upper part in the dip coating) of the support. The coating solution in the region of 3 mm from the other end (the lower part in the dip coating) was wiped away after the dip coating.

TABLE 3

Production conditions and physical properties of photoreceptor

| | | | Intermediate layer | | | | Undercoat layer | | | Charge generating layer | |
|---|---|---|---|---|---|---|---|---|---|---|---|
| Photoreceptor No. | Support Type | Conductive layer | Type of coating solution | Average thickness (μm) | $Rz_{JIS}$ (μm) | Martens hardness (N/mm$^2$) | Type of coating solution | Area rate of undercoat layer (%) | Average thickness (μm) | Average thickness of first portion (μm) | Average thickness of second portion (μm) |
| Photoreceptor 1-1 | Support A | present | Coating solution A | 5 | 0.4 | 200 | Coating solution a | 80 | 0.8 | 0.15 | 0.15 |
| Photoreceptor 1-2 | Support A | present | Coating solution B | 20 | 2.6 | 500 | Coating solution b | 80 | 0.8 | 0.15 | 0.15 |
| Photoreceptor 1-3 | Support A | present | Coating solution C | 5 | 0.4 | 200 | Coating solution a | 80 | 0.8 | 0.15 | 0.15 |
| Photoreceptor 1-4 | Support A | present | Coating solution D | 5 | 2.6 | 500 | Coating solution c | 80 | 0.8 | 0.15 | 0.15 |
| Photoreceptor 1-5 | Support A | present | Coating solution E | 5 | 0.8 | 400 | Coating solution a | 80 | 0.8 | 0.15 | 0.15 |
| Photoreceptor 1-6 | Support A | present | Coating solution E | 5 | 0.8 | 400 | Coating solution a | 50 | 0.8 | 0.15 | 0.15 |
| Photoreceptor 1-7 | Support A | present | Coating solution E | 5 | 0.8 | 400 | Coating solution a | 10 | 0.8 | 0.15 | 0.15 |
| Photoreceptor 1-8 | Support A | present | Coating solution E | 5 | 0.8 | 400 | Coating solution a | 0 | 0.8 | 0.15 | 0.15 |
| Photoreceptor 1-9 | Support A | present | Coating solution F | 20 | 1.1 | 470 | Coating solution d | 80 | 0.8 | 0.15 | 0.15 |
| Photoreceptor 1-10 | Support A | present | Coating solution F | 20 | 1.1 | 470 | Coating solution a | 50 | 0.8 | 0.15 | 0.15 |

TABLE 3-continued

| Production conditions and physical properties of photoreceptor | | | | | | | | | | | |
|---|---|---|---|---|---|---|---|---|---|---|---|
| | | | Intermediate layer | | | | Undercoat layer | | | Charge generating layer | |
| Photoreceptor No. | Support Type | Conductive layer | Type of coating solution | Average thickness (μm) | $Rz_{JIS}$ (μm) | Martens hardness ($N/mm^2$) | Type of coating solution | Area rate of undercoat layer (%) | Average thickness (μm) | Average thickness of first portion (μm) | Average thickness of second portion (μm) |
| Photoreceptor 1-11 | Support A | present | Coating solution F | 20 | 1.1 | 470 | Coating solution e | 10 | 0.8 | 0.15 | 0.15 |
| Photoreceptor 1-12 | Support A | present | Coating solution F | 20 | 1.1 | 470 | Coating solution f | 0 | 0.8 | 0.15 | 0.15 |
| Photoreceptor 1-13 | Support A | present | Coating solution G | 5 | 0.8 | 380 | Coating solution a | 80 | 0.8 | 0.15 | 0.15 |
| Photoreceptor 1-14 | Support A | present | Coating solution G | 5 | 0.8 | 380 | Coating solution a | 50 | 0.8 | 0.15 | 0.15 |
| Photoreceptor 1-15 | Support A | present | Coating solution G | 5 | 0.8 | 380 | Coating solution a | 10 | 0.8 | 0.15 | 0.15 |
| Photoreceptor 1-16 | Support A | present | Coating solution G | 5 | 0.8 | 380 | Coating solution a | 0 | 0.8 | 0.15 | 0.15 |
| Photoreceptor 1-17 | Support A | present | Coating solution H | 5 | 1.1 | 470 | Coating solution d | 80 | 0.8 | 0.15 | 0.15 |
| Photoreceptor 1-18 | Support A | present | Coating solution H | 5 | 1.1 | 470 | Coating solution a | 50 | 0.8 | 0.15 | 0.15 |
| Photoreceptor 1-19 | Support A | present | Coating solution H | 5 | 1.1 | 470 | Coating solution e | 10 | 0.8 | 0.15 | 0.15 |
| Photoreceptor 1-20 | Support A | present | Coating solution H | 5 | 1.1 | 470 | Coating solution f | 0 | 0.8 | 0.15 | 0.15 |
| Photoreceptor 1-21 | Support A | present | Coating solution E | 5 | 0.8 | 400 | Coating solution a | 0 | 0.8 | 0.15 | 0.05 (3 to 8 mm from the upper end of the support) |
| Photoreceptor 1-22 | Support A | present | Coating solution G | 5 | 0.8 | 380 | Coating solution a | 0 | 0.8 | 0.15 | |
| Photoreceptor 1-23 | Support B | present | Coating solution E | 5 | 0.8 | 400 | Coating solution a | 0 | 0.8 | 0.15 | |
| Photoreceptor 1-24 | Support B | present | Coating solution G | 5 | 0.8 | 380 | Coating solution a | 0 | 0.8 | 0.15 | |
| Photoreceptor 1-25 | Support A | present | Coating solution I | 5 | 0.8 | 300 | Coating solution a | 0 | 0.8 | 0.15 | |
| Photoreceptor 1-26 | Support A | present | Coating solution J | 5 | 0.8 | 300 | Coating solution a | 0 | 0.8 | 0.15 | |
| Photoreceptor 1-27 | Support A | present | Coating solution K | 1 | 0.6 | 70 | Coating solution a | 80 | 0.8 | 0.15 | |
| Photoreceptor 1-28 | Support A | present | Coating solution K | 1 | 0.6 | 70 | Coating solution a | 50 | 0.8 | 0.15 | |
| Photoreceptor 1-29 | Support A | present | Coating solution K | 1 | 0.6 | 70 | Coating solution a | 10 | 0.8 | 0.15 | |
| Photoreceptor 1-30 | Support A | present | Coating solution K | 1 | 0.6 | 70 | Coating solution a | 0 | 0.8 | 0.15 | |
| Photoreceptor 1-31 | Support A | present | Coating solution L | 1 | 0.6 | 70 | Coating solution a | 80 | 0.8 | 0.15 | |
| Photoreceptor 1-32 | Support A | present | Coating solution L | 1 | 0.6 | 70 | Coating solution a | 50 | 0.8 | 0.15 | |
| Photoreceptor 1-33 | Support A | present | Coating solution L | 1 | 0.6 | 70 | Coating solution a | 10 | 0.8 | 0.15 | |
| Photoreceptor 1-34 | Support A | present | Coating solution L | 1 | 0.6 | 70 | Coating solution a | 0 | 0.8 | 0.15 | |
| Photoreceptor 1-35 | Support A | present | Coating solution M | 1 | 1.2 | 20 | Coating solution a | 80 | 0.8 | 0.15 | |
| Photoreceptor 1-36 | Support A | present | Coating solution M | 1 | 1.2 | 20 | Coating solution a | 50 | 0.8 | 0.15 | |
| Photoreceptor 1-37 | Support A | present | Coating solution M | 1 | 1.2 | 20 | Coating solution a | 10 | 0.8 | 0.15 | |
| Photoreceptor 1-38 | Support A | present | Coating solution M | 1 | 1.2 | 20 | Coating solution a | 0 | 0.8 | 0.15 | |
| Photoreceptor 1-39 | Support A | present | Coating solution N | 1 | 1.3 | 20 | Coating solution a | 80 | 0.8 | 0.15 | |
| Photoreceptor 1-40 | Support A | present | Coating solution N | 1 | 1.3 | 20 | Coating solution a | 50 | 0.8 | 0.15 | |
| Photoreceptor 1-41 | Support A | present | Coating solution N | 1 | 1.3 | 20 | Coating solution a | 10 | 0.8 | 0.15 | |
| Photoreceptor 1-42 | Support A | present | Coating solution N | 1 | 1.3 | 20 | Coating solution a | 0 | 0.8 | 0.15 | |
| Photoreceptor 1-43 | Support A | present | Coating solution M | 1 | 1.2 | 20 | Coating solution a | 0 | 0.8 | 0.15 | 0.05 (3 to 7 mm from the upper end of the support) |

TABLE 3-continued

| Production conditions and physical properties of photoreceptor | | | | | | | | | | | |
|---|---|---|---|---|---|---|---|---|---|---|---|
| | | | Intermediate layer | | | | Undercoat layer | | | Charge generating layer | |
| Photoreceptor No. | Support Type | Conductive layer | Type of coating solution | Average thickness (μm) | $Rz_{JIS}$ (μm) | Martens hardness ($N/mm^2$) | Type of coating solution | Area rate of undercoat layer (%) | Average thickness (μm) | Average thickness of first portion (μm) | Average thickness of second portion (μm) |
| Photoreceptor 1-44 | Support A | present | Coating solution N | 1 | 1.2 | 20 | Coating solution a | 0 | 0.8 | 0.15 | 0.05 (3 to 8 mm from the upper end of the support) |
| Photoreceptor 1-45 | Support A | present | Coating solution P | 0.3 | 1.2 | 20 | Coating solution g | 0 | 0.7 | 0.15 | |

TABLE 4

| Production conditions and physical properties of photoreceptor | | | | | | | | | | | |
|---|---|---|---|---|---|---|---|---|---|---|---|
| | | | Intermediate layer | | | | Undercoat layer | | | Charge generating layer | |
| Photoreceptor No. | Support Type | Conductive layer | Type of coating solution | Average thickness (μm) | $Rz_{JIS}$ (μm) | Martens hardness ($N/mm^2$) | Type of coating solution | Area rate of undercoat layer (%) | Average thickness (μm) | Average thickness of first portion (μm) | Average thickness of second portion (μm) |
| Photoreceptor 1-46 | Support A | present | Coating solution P | 0.3 | 1.2 | 20 | Coating solution h | 0 | 0.5 | 0.15 | 0.05 (3 to 8 mm from the upper end of the support) |
| Photoreceptor 1-47 | Support A | present | Coating solution Q | 0.5 | 1.2 | 20 | Coating solution i | 0 | 0.7 | 0.15 | |
| Photoreceptor 1-48 | Support A | present | Coating solution R | 0.1 | 1.2 | 20 | Coating solution j | 0 | 0.7 | 0.15 | |
| Photoreceptor 1-49 | Support A | present | Coating solution P | 0.6 | 1.2 | 20 | Coating solution k | 0 | 0.7 | 0.15 | |
| Photoreceptor 1-50 | Support A | present | Coating solution P | 0.2 | 1.2 | 20 | Coating solution a | 0 | 0.8 | 0.15 | |
| Photoreceptor 1-51 | Support A | present | Coating solution S | 0.5 | 1.2 | 100 | Coating solution l | 0 | 0.7 | 0.15 | |
| Photoreceptor 1-52 | Support A | present | Coating solution T | 0.5 | 1.2 | 110 | Coating solution e | 0 | 0.6 | 0.15 | |
| Photoreceptor 1-53 | Support A | present | Coating solution Q | 0.5 | 1.2 | 20 | Coating solution m | 0 | 0.7 | 0.15 | |
| Photoreceptor 1-54 | Support A | present | Coating solution R | 0.1 | 1.2 | 20 | Coating solution n | 0 | 0.7 | 0.15 | |
| Photoreceptor 1-55 | Support A | present | Coating solution P | 0.3 | 1.2 | 20 | Coating solution d | 0 | 0.7 | 0.15 | |
| Photoreceptor 1-56 | Support A | present | Coating solution P | 0.3 | 1.2 | 20 | Coating solution o | 0 | 0.6 | 0.15 | |
| Photoreceptor 1-57 | Support A | present | Coating solution P | 0.3 | 1.2 | 20 | Coating solution p | 0 | 0.7 | 0.15 | |
| Photoreceptor 1-58 | Support A | present | Coating solution P | 0.3 | 1.2 | 20 | Coating solution q | 0 | 0.6 | 0.15 | |
| Photoreceptor 1-59 | Support A | present | Coating solution P | 0.3 | 1.2 | 20 | Coating solution q | 0 | 0.6 | 0.15 | |
| Photoreceptor 1-60 | Support A | present | Coating solution P | 0.3 | 1.2 | 20 | Coating solution r | 0 | 0.6 | 0.15 | |
| Photoreceptor 1-61 | Support A | present | Coating solution P | 0.3 | 1.2 | 20 | Coating solution b | 0 | 0.7 | 0.15 | |
| Photoreceptor 1-62 | Support A | present | Coating solution P | 0.3 | 1.2 | 20 | Coating solution a | 0 | 0.6 | 0.15 | |
| Photoreceptor 1-63 | Support A | present | Coating solution P | 0.3 | 1.2 | 20 | Coating solution d | 0 | 0.7 | 0.15 | |
| Photoreceptor 1-64 | Support A | present | Coating solution P | 0.3 | 1.2 | 20 | Coating solution a | 0 | 0.8 | 0.15 | |
| Photoreceptor 1-65 | Support B | present | Coating solution P | 0.3 | 1.2 | 20 | Coating solution a | 0 | 0.7 | 0.15 | |
| Photoreceptor 1-66 | Support B | present | Coating solution P | 0.3 | 1.2 | 20 | Coating solution h | 0 | 0.7 | 0.15 | 0.05 (3 to 8 mm from the upper end of the support) |
| Photoreceptor 1-67 | Support B | present | Coating solution Q | 0.5 | 1.2 | 20 | Coating solution g | 0 | 0.7 | 0.15 | |
| Photoreceptor 1-68 | Support B | present | Coating solution Q | 0.1 | 1.2 | 20 | Coating solution h | 0 | 0.7 | 0.15 | |
| Photoreceptor 1-69 | Support B | present | Coating solution P | 0.6 | 1.2 | 20 | Coating solution s | 0 | 0.7 | 0.15 | |

TABLE 4-continued

| Production conditions and physical properties of photoreceptor | | | | | | | | | | | |
|---|---|---|---|---|---|---|---|---|---|---|---|
| | | | Intermediate layer | | | | Undercoat layer | | | Charge generating layer | |
| Photoreceptor No. | Support Type | Conductive layer | Type of coating solution | Average thickness (μm) | $Rz_{JIS}$ (μm) | Martens hardness ($N/mm^2$) | Type of coating solution | Area rate of undercoat layer (%) | Average thickness (μm) | Average thickness of first portion (μm) | Average thickness of second portion (μm) |
| Photoreceptor 1-70 | Support B | present | Coating solution S | 0.5 | 1.2 | 100 | Coating solution i | 0 | 0.7 | 0.15 | |
| Photoreceptor 1-71 | Support B | present | Coating solution T | 0.5 | 1.2 | 110 | Coating solution i | 0 | 0.7 | 0.15 | |
| Photoreceptor 1-72 | Support B | present | Coating solution P | 0.3 | 1.2 | 20 | Coating solution q | 0 | 0.6 | 0.15 | |
| Photoreceptor 1-73 | Support B | present | Coating solution P | 0.3 | 1.2 | 20 | Coating solution r | 0 | 0.6 | 0.15 | |
| Photoreceptor 1-74 | Support B | present | Coating solution P | 0.3 | 1.2 | 20 | Coating solution b | 0 | 0.7 | 0.15 | |
| Photoreceptor 1-75 | Support B | present | Coating solution P | 0.3 | 1.2 | 20 | Coating solution a | 0 | 0.6 | 0.15 | |
| Photoreceptor 1-76 | Support B | present | Coating solution P | 0.3 | 1.2 | 20 | Coating solution d | 0 | 0.7 | 0.15 | |
| Photoreceptor 1-77 | Support B | present | Coating solution P | 0.3 | 1.2 | 20 | Coating solution a | 0 | 0.8 | 0.15 | |
| Photoreceptor 1-78 | Support A | present | Coating solution U | 0.6 | 1.2 | 20 | Coating solution a | 0 | 0.7 | 0.15 | |
| Photoreceptor 1-79 | Support A | present | Coating solution U | 0.6 | 1.2 | 20 | Coating solution s | 0 | 0.7 | 0.15 | |
| Photoreceptor 1-80 | Support A | present | Coating solution U | 0.4 | 1.2 | 20 | Coating solution a | 80 | 0.6 | 0.15 | |
| Photoreceptor 1-81 | Support B | present | Coating solution U | 0.7 | 1.2 | 20 | Coating solution a | 0 | 0.8 | 0.15 | |
| Phatoreceptor 1-82 | Support B | present | Coating solution U | 0.6 | 1.2 | 20 | Coating solution a | 0 | 0.7 | 0.15 | |
| Photoreceptor 1-83 | Support B | present | Coating solution U | 0.6 | 1.2 | 20 | Coating solution s | 80 | 0.7 | 0.15 | |
| Photoreceptor 1-84 | Support B | present | Coating solution U | 0.6 | 1.2 | 20 | Coating solution a | 0 | 0.7 | 0.15 | |
| Photoreceptor 1-85 | Support C | — | Coating solution P | 0.3 | 1.2 | 20 | Coating solution g | 0 | 0.7 | 0.15 | |
| Photoreceptor 1-86 | Support C | — | Coating solution P | 0.3 | 1.2 | 20 | Coating solution g | 0 | 0.7 | 0.15 | |
| Photoreceptor 1-87 | Support A | present | Coating solution F | 20 | 1.1 | 500 | Coating solution f | 100 | 0.8 | 0.15 | |
| Photoreceptor 1-88 | Support A | present | Coating solution H | 5 | 1.1 | 500 | Coating solution f | 100 | 0.8 | 0.15 | |
| Photoreceptor 1-89 | Support A | present | Coating solution M | 1 | 1.2 | 20 | Coating solution f | 100 | 0.8 | 0.15 | |
| Photoreceptor 1-90 | Support A | present | Coating solution N | 1 | 1.3 | 20 | Coating solution f | 100 | 0.8 | 0.15 | |
| Photoreceptor 1-91 | Support A | present | Coating solution O | 5 | 1.5 | 550 | Coating solution f | 100 | 0.8 | 0.15 | |
| Photoreceptor 1-92 | Support A | present | Coating solution U | 0.6 | 1.2 | 20 | Coating solution a | 0 | 0.7 | 0.15 | |

(Production of Electrophotographic Photoreceptor 1-93)

Electrophotographic photoreceptor 1-93 was produced as in the production of electrophotographic photoreceptor 1-1, except for the following points.

(1) The support used was an aluminum cylinder (JIS-A3003, aluminum alloy) having a length of 357.5 mm and a diameter of 30 mm.

(2) The intermediate layer was formed in the region of 18 mm, instead of 15 mm, from one end of the support by dip coating of the intermediate layer coating solution.

(3) The surface layer coating solution was not applied, and a charge transporting layer coating solution and a surface protecting layer coating solution were applied to form a charge transporting layer having a thickness of 18 μm and a surface protecting layer having a thickness of 5 μm in this order.

The charge transporting layer was formed by dip coating of the charge transporting layer coating solution shown below and drying the resulting coating film at 110° C. for 60 minutes. In this dip coating, the charge transporting layer coating solution was not applied to the region of 3 mm from one end (the upper part in the dip coating) of the support. The coating solution in the region of 3 mm from the other end (the lower part in the dip coating) was wiped away after the dip coating.

The charge transporting layer coating solution was prepared by dissolving two compounds (each 5 parts) represented by the following formulae and polycarbonate (Iupilon Z400, manufactured by Mitsubishi Gas Chemical Company, 10 parts) in a solvent mixture of chlorobenzene (650 parts) and dimethoxymethane (150 parts).

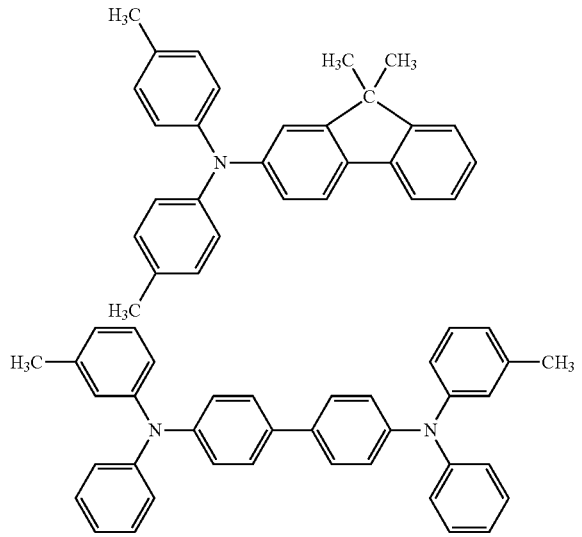

The surface protecting layer was formed as follows. Dip coating of the surface protecting layer coating solution described below was performed, and the resulting coating film was dried at 50° C. for 5 minutes. The coating film was then irradiated with electron rays for 1.6 seconds under a nitrogen atmosphere at an accelerating voltage of 70 kV and an absorbed dose of 13000 Gy, while rotating the support, to cure the coating film. The coating film was further heat-treated under a nitrogen atmosphere at a coating film temperature of 120° C. for 3 minutes. The oxygen concentration after the irradiation with electron rays until the heat treatment was 20 ppm. Subsequently, the coating film was heat-treated in the atmosphere at a coating film temperature of 100° C. for 30 minutes to form a surface protecting layer.

The surface protecting layer coating solution was prepared by dissolving the compound (100 parts) represented by the following formula in a solvent mixture of 1,1,2,2,3,3,4-heptafluorocyclopentane (Zeorora H, manufactured by Zeon Corporation, 80 parts) and 1-propanol (80 parts) and filtering the solution through a polyflon filter (PF-020, manufactured by Advangtec Toyo Kaisya, Ltd.).

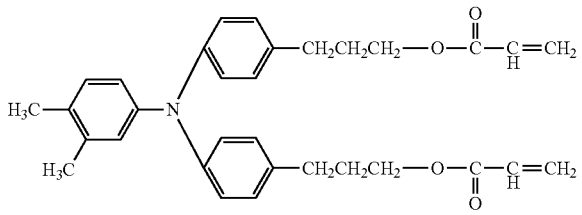

(4) After the formation of the surface protecting layer, a surface profile was formed on the surface of the photoreceptor with a mold. The mold has dome-like convexes having a base long-axis diameter of 50 μm and a height of 2.0 μm at intervals of 8 μm. The mold was pressed to the photoreceptor, while maintaining the temperature of the surface of the photoreceptor and the mold at 110° C. and rotating the photoreceptor in the circumferential direction, to transfer the surface profile. Concaves having a long-axis diameter of 50 μm and a depth of 1.0 μm at intervals of 8 μm were observed by investigation of the surface of the resulting photoreceptor with a laser microscope (VK-9500, manufactured by Keyence Corporation).

(Production of Electrophotographic Photoreceptor 1-94)

Electrophotographic photoreceptor 1-94 was produced as in electrophotographic photoreceptor 1-93, except that the surface protecting layer was formed using the surface protecting layer coating solution prepared as below and changing the absorbed dose of the electron rays to 8500 Gy.

The surface protecting layer coating solution was prepared as follows. A fluorine atom-containing resin (GF-300, manufactured by Toagosei Co., Ltd., 1.5 parts) was dissolved in a solvent mixture of 1,1,2,2,3,3,4-heptafluorocyclopentane (Zeorora H, manufactured by Zeon Corporation, 45 parts) and 1-propanol (45 parts), and a lubricant, ethylene tetrafluoride resin powder, (Lubron L-2, manufactured by Daikin Industries, Ltd., 30 parts) was added thereto. The resulting solution was subjected to dispersion treatment with a high-pressure disperser (Microfluidizer M-110EH, manufactured by Microfluidics Corporation) at a pressure of 58.8 MPa (600 kgf/cm$^2$) for four times and was then filtered through a polyflon filter (PF-040, manufactured by Advangtec Toyo Kaisya, Ltd.) to prepare a dispersion solution. The dispersion solution was mixed with a compound (70 parts) represented by the following formula, 1,1,2,2,3,3,4-heptafluorocyclopentane (Zeorora H, manufactured by Zeon Corporation, 35 parts), and 1-propanol (35 parts). The resulting mixture was filtered through a polyflon filter (PF-020, manufactured by Advangtec Toyo Kaisya, Ltd.) to give a surface protecting layer coating solution.

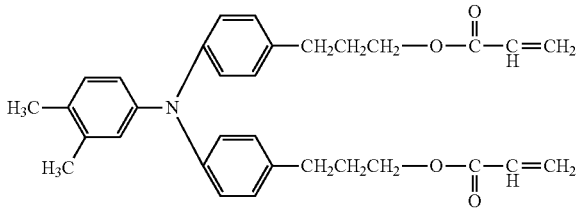

(7-2) Production of Electrophotographic Photoreceptors 2-1 to 2-49 (FIG. 1B-1)

An intermediate layer coating solution was applied to a support by dip coating. The resulting coating film was dried and heat-cured at 170° C. for 60 minutes (in photoreceptors 2-35 to 2-44, at 70° C. for 6 minutes) to form an intermediate layer. The resulting intermediate layers were each subjected to measurement of ten-point average roughness $Rz_{JIS}$ (reference length: 0.8 mm) at positions of 130 mm from one end of the support with a surface roughness measuring meter (Surfcorder SE-3400, manufactured by Kosaka Laboratory Ltd.).

Subsequently, an undercoat layer coating solution was applied to the support provided with the intermediate layer by dip coating. The resulting coating film was heated at 160° C. for 60 minutes for polymerization to form an undercoat layer. In photoreceptors 2-1 to 2-44, in the dip coating, the undercoat layer coating solution was not applied to the region of 15 mm from one end (the upper part in the dip coating) of the support. The undercoat layer in the region of 15 mm from the other end (the lower part in the dip coating) was partially or completely removed after the dip coating by wetting with a cyclohexanone solvent and rubbing with a rubber blade. In photoreceptors 2-45 to 2-49, the undercoat layer was formed by dip coating in the region excluding the region of 3 mm from one end (the upper part in the dip coating) and the region of 3 mm from the other end (the lower part in the dip coating) of the support.

A charge generating layer coating solution was further applied to the support provided with the intermediate layer and the undercoat layer by dip coating. The resulting coating film was dried at 100° C. for 10 minutes to form a charge generating layer. In this dip coating, the charge generating layer coating solution was not applied to the region of 3 mm from one end (the upper part in the dip coating) of the support. The coating solution in the region of 3 mm from the other end (the lower part in the dip coating) was wiped away after the dip coating.

Lastly, a surface layer coating solution was applied to the support provided with the intermediate layer, the undercoat layer, and the charge generating layer by dip coating. The resulting coating film was dried at 120° C. for 20 minutes to form a surface layer. In this dip coating, the surface layer coating solution was not applied to the region of 3 mm from one end (the upper part in the dip coating) of the support. The coating solution in the region of 3 mm from the other end (the lower part in the dip coating) was wiped away after the dip coating.

TABLE 5

Production conditions and physical properties of photoreceptor

| | | Intermediate layer | | | | Undercoat layer | | | Charge generating layer | |
|---|---|---|---|---|---|---|---|---|---|---|
| Photoreceptor No. | Support Type | Type of coating solution | Average thickness (μm) | $Rz_{JIS}$ (μm) | Martens hardness ($N/mm^2$) | Type of coating solution | Area rate of undercoat layer (%) | Average thickness (μm) | Average thickness of first portion (μm) | Average thickness of second portion (μm) |
| Photoreceptor 2-1 | Support A | Coating solution A | 5 | 0.4 | 200 | Coating solution a | 80 | 0.8 | 0.15 | 0.15 |
| Photoreceptor 2-2 | Support A | Coating solution B | 20 | 2.6 | 500 | Coating solution b | 80 | 0.8 | 0.15 | 0.15 |
| Photoreceptor 2-3 | Support A | Coating solution C | 5 | 0.4 | 200 | Coating solution a | 80 | 0.8 | 0.15 | 0.15 |
| Photoreceptor 2-4 | Support A | Coating solution D | 5 | 2.6 | 500 | Coating solution c | 80 | 0.8 | 0.15 | 0.15 |
| Photoreceptor 2-5 | Support A | Coating solution E | 5 | 0.8 | 300 | Coating solution a | 80 | 0.8 | 0.15 | 0.15 |
| Photoreceptor 2-6 | Support A | Coating solution E | 5 | 0.8 | 300 | Coating solution a | 50 | 0.8 | 0.15 | 0.15 |
| Photoreceptor 2-7 | Support A | Coating solution E | 5 | 0.8 | 300 | Coating solution a | 10 | 0.8 | 0.15 | 0.15 |
| Photoreceptor 2-8 | Support A | Coating solution E | 5 | 0.8 | 300 | Coating solution a | 0 | 0.8 | 0.15 | 0.15 |
| Photoreceptor 2-9 | Support A | Coating solution F | 20 | 1.1 | 470 | Coating solution d | 80 | 0.8 | 0.15 | 0.15 |
| Photoreceptor 2-10 | Support A | Coating solution F | 20 | 1.1 | 470 | Coating solution a | 50 | 0.8 | 0.15 | 0.15 |
| Photoreceptor 2-11 | Support A | Coating solution F | 20 | 1.1 | 470 | Coating solution e | 10 | 0.8 | 0.15 | 0.15 |
| Photoreceptor 2-12 | Support A | Coating solution F | 20 | 1.1 | 470 | Coating solution f | 0 | 0.8 | 0.15 | 0.15 |
| Photoreceptor 2-13 | Support A | Coating solution G | 5 | 0.8 | 380 | Coating solution a | 80 | 0.8 | 0.15 | 0.15 |
| Photoreceptor 2-14 | Support A | Coating solution G | 5 | 0.8 | 380 | Coating solution a | 50 | 0.8 | 0.15 | 0.15 |
| Photoreceptor 2-15 | Support A | Coating solution G | 5 | 0.8 | 380 | Coating solution a | 10 | 0.8 | 0.15 | 0.15 |
| Photoreceptor 2-16 | Support A | Coating solution G | 5 | 0.8 | 380 | Coating solution a | 0 | 0.8 | 0.15 | 0.15 |
| Photoreceptor 2-17 | Support A | Coating solution H | 5 | 1.1 | 470 | Coating solution d | 80 | 0.8 | 0.15 | 0.15 |
| Photoreceptor 2-18 | Support A | Coating solution H | 5 | 1.1 | 470 | Coating solution a | 50 | 0.8 | 0.15 | 0.15 |
| Photoreceptor 2-19 | Support A | Coating solution H | 5 | 1.1 | 470 | Coating solution e | 10 | 0.8 | 0.15 | 0.15 |
| Photoreceptor 2-20 | Support A | Coating solution H | 5 | 1.1 | 470 | Coating solution f | 0 | 0.8 | 0.15 | 0.15 |
| Photoreceptor 2-21 | Support A | Coating solution E | 5 | 0.8 | 300 | Coating solution a | 0 | 0.8 | 0.15 | 0.05 (3 to 8 mm from the upper end of the support) |
| Photoreceptor 2-22 | Support A | Coating solution G | 5 | 0.8 | 380 | Coating solution a | 0 | 0.8 | 0.15 | |
| Photoreceptor 2-23 | Support B | Coating solution E | 5 | 0.8 | 300 | Coating solution a | 0 | 0.8 | 0.15 | |
| Photoreceptor 2-24 | Support B | Coating solution G | 5 | 0.8 | 380 | Coating solution a | 0 | 0.8 | 0.15 | |
| Photoreceptor 2-25 | Support A | Coating solution I | 5 | 0.8 | 300 | Coating solution a | 0 | 0.8 | 0.15 | |
| Photoreceptor 2-26 | Support A | Coating solution J | 5 | 0.8 | 300 | Coating solution a | 0 | 0.8 | 0.15 | |
| Photoreceptor 2-27 | Support A | Coating solution K | 1 | 0.6 | 70 | Coating solution a | 80 | 0.8 | 0.15 | 0.05 (3 to 8 mm from the |

TABLE 5-continued

| Production conditions and physical properties of photoreceptor | | | | | | | | | | |
|---|---|---|---|---|---|---|---|---|---|---|
| | | Intermediate layer | | | | Undercoat layer | | | Charge generating layer | |
| Photoreceptor No. | Support Type | Type of coating solution | Average thickness (μm) | $Rz_{JIS}$ (μm) | Martens hardness (N/mm$^2$) | Type of coating solution | Area rate of undercoat layer (%) | Average thickness (μm) | Average thickness of first portion (μm) | Average thickness of second portion (μm) |
| Photoreceptor 2-28 | Support A | Coating solution K | 1 | 0.6 | 70 | Coating solution a | 50 | 0.8 | 0.15 | upper end of the support) |
| Photoreceptor 2-29 | Support A | Coating solution K | 1 | 0.6 | 70 | Coating solution a | 10 | 0.8 | 0.15 | |
| Photoreceptor 2-30 | Support A | Coating solution K | 1 | 0.6 | 70 | Coating solution a | 0 | 0.8 | 0.15 | |
| Photoreceptor 2-31 | Support A | Coating solution L | 1 | 0.6 | 70 | Coating solution a | 80 | 0.8 | 0.15 | |
| Photoreceptor 2-32 | Support A | Coating solution L | 1 | 0.6 | 70 | Coating solution a | 50 | 0.8 | 0.15 | |
| Photoreceptor 2-33 | Support A | Coating solution L | 1 | 0.6 | 70 | Coating solution a | 10 | 0.8 | 0.15 | |
| Photoreceptor 2-34 | Support A | Coating solution L | 1 | 0.6 | 70 | Coating solution a | 0 | 0.8 | 0.15 | |
| Photoreceptor 2-35 | Support A | Coating solution M | 1 | 1.2 | 20 | Coating solution a | 80 | 0.8 | 0.15 | |
| Photoreceptor 2-36 | Support A | Coating solution M | 1 | 1.2 | 20 | Coating solution a | 50 | 0.8 | 0.15 | |
| Photoreceptor 2-37 | Support A | Coating solution M | 1 | 1.2 | 20 | Coating solution a | 10 | 0.8 | 0.15 | |
| Photoreceptor 2-38 | Support A | Coating solution M | 1 | 1.2 | 20 | Coating solution a | 0 | 0.8 | 0.15 | |
| Photoreceptor 2-39 | Support A | Coating solution N | 1 | 1.3 | 20 | Coating solution a | 80 | 0.8 | 0.15 | |
| Photoreceptor 2-40 | Support A | Coating solution N | 1 | 1.3 | 20 | Coating solution a | 50 | 0.8 | 0.15 | |
| Photoreceptor 2-41 | Support A | Coating solution N | 1 | 1.3 | 20 | Coating solution a | 10 | 0.8 | 0.15 | |
| Photoreceptor 2-42 | Support A | Coating solution N | 1 | 1.3 | 20 | Coating solution a | 0 | 0.8 | 0.15 | 0.05 (3 to 8 mm from the upper end of the support) |
| Photoreceptor 2-43 | Support A | Coating solution M | 1 | 1.2 | 20 | Coating solution a | 0 | 0.8 | 0.15 | 0.05 (3 to 7 mm from the upper end of the support) |
| Photoreceptor 2-44 | Support A | Coating solution N | 1 | 1.2 | 20 | Coating solution a | 0 | 0.8 | 0.15 | 0.05 (7 to 11 mm from the upper end of the support) |
| Photoreceptor 2-45 | Support A | Coating solution F | 20 | 1.1 | 500 | Coating solution f | 100 | 0.8 | 0.15 | 0.15 |
| Photoreceptor 2-46 | Support A | Coating solution H | 5 | 1.1 | 500 | Coating solution f | 100 | 0.8 | 0.15 | 0.15 |
| Photoreceptor 2-47 | Support A | Coating solution M | 1 | 1.2 | 20 | Coating solution f | 100 | 0.8 | 0.15 | 0.05 (3 to 8 mm from the |
| Photoreceptor 2-48 | Support A | Coating solution N | 1 | 1.3 | 20 | Coating solution f | 100 | 0.8 | 0.15 | upper end of the support) |
| Photoreceptor 2-49 | Support A | Coating solution O | 5 | 1.5 | 550 | Coating solution f | 100 | 0.8 | 0.15 | 0.15 |

(7-3) Production of Electrophotographic Photoreceptors 3-1 to 3-92 (FIG. 1A-2)

Electrophotographic photoreceptors 3-1 to 3-92 were produced as in the production of electrophotographic photoreceptors 1-1 to 1-92 in paragraph (7-1), except that the order of application of the charge generating layer and the intermediate layer was reversed. That is, the charge generating layer coating solution was applied to the support provided with the undercoat layer by dip coating to form a charge generating layer, and the intermediate layer coating solution was applied to one end part or both end parts of the support by dip coating to form an intermediate layer.

(7-4) Production of Electrophotographic Photoreceptors 4-1 to 4-7 (FIG. 1B-2)

An undercoat layer coating solution was applied to a support by dip coating. The resulting coating film was heated at 160° C. for 60 minutes for polymerization to form an undercoat layer. In the dip coating, the undercoat layer coating solution was not applied to the region of 15 mm from one end (the upper part in the dip coating) of the support. The undercoat layer in the region of 15 mm from the other end (the lower part in the dip coating) was partially or completely removed after the dip coating by wetting with a cyclohexanone solvent and rubbing with a rubber blade.

Subsequently, a charge generating layer coating solution was applied to the support provided with the undercoat layer by dip coating. The resulting coating film was dried at 100° C. for 10 minutes to form a charge generating layer. In the dip coating, the charge generating layer coating solution was not applied to the region of 3 mm from one end (the upper part in the dip coating) of the support. The coating solution in the region of 3 mm from the other end (the lower part in the dip coating) was wiped away after the dip coating.

Subsequently, (i) in photoreceptors 4-1 to 4-3, an intermediate layer coating solution was applied to the region of 17 mm from one end (the lower part in the dip coating) of the support by dip coating, and the resulting coating film was air-dried at room temperature for 2 minutes to form an intermediate layer only at the lower end part (air drying/only lower end part);

(ii) in photoreceptors 4-4 and 4-5, an intermediate layer coating solution was applied to the region of 17 mm from one end of the support and the region of 17 mm from the other end of the support by dip coating, and the resulting coating film was air-dried at room temperature for 2 minutes to form intermediate layers at both end parts (air drying/both end parts); and (iii) in photoreceptors 4-6 and 4-7, an intermediate layer coating solution was not applied to the region of 3 mm from one end (the lower part in the dip coating) of the support in the dip coating, and the coating solution in the region of 3 mm from the other end (the lower part in the dip coating) was wiped away after the dip coating. The resulting coating film was air-dried at room temperature for 2 minutes to form an intermediate layer (whole area/air drying).

The resulting intermediate layers were each subjected to measurement of ten-point average roughness $Rz_{JIS}$ (reference length: 0.8 mm) at positions of 130 mm from one end of the support with a surface roughness measuring meter (Surfcorder SE-3400, manufactured by Kosaka Laboratory Ltd.).

Lastly, a surface layer coating solution was applied to the support provided with the intermediate layer, the undercoat layer, and the charge generating layer by dip coating. The resulting coating film was dried at 120° C. for 20 minutes to form a surface layer. In this dip coating, the surface layer coating solution was not applied to the region of 3 mm from one end (the upper part in the dip coating) of the support. The coating solution in the region of 3 mm from the other end (the lower part in the dip coating) was wiped away after the dip coating.

TABLE 6

Production conditions and physical properties of photoreceptor

| | | | Intermediate layer | | | | Undercoat layer | | | Charge generating layer | |
|---|---|---|---|---|---|---|---|---|---|---|---|
| Photoreceptor No. | Support Type | Conductive layer | Type of coating solution | Average thickness (μm) | $Rz_{JIS}$ (μm) | Martens hardness ($N/mm^2$) | Type of coating solution | Area rate of undercoat layer (%) | Average thickness (μm) | Average thickness of first portion (μm) | Average thickness of second portion (μm) |
| Photoreceptor 4-1 | Support A | present | Coating solution P | 0.3 | 1.2 | 20 | Coating solution a | 0 | 0.6 | 0.15 | 0.15 |
| Photoreceptor 4-2 | Support A | present | Coating solution R | 0.6 | 1.2 | 20 | Coating solution a | 80 | 0.6 | 0.15 | 0.15 |
| Photoreceptor 4-3 | Support A | present | Coating solution R | 0.6 | 1.2 | 20 | Coating solution a | 80 | 0.6 | 0.15 | 0.15 |
| Photoreceptor 4-4 | Support A | present | Coating solution Q | 0.5 | 1.2 | 20 | Coating solution i | 0 | 0.7 | 0.15 | 0.15 |
| Photoreceptor 4-5 | Support A | present | Coating solution P | 0.6 | 1.2 | 20 | Coating solution a | 0 | 0.8 | 0.15 | 0.15 |
| Photoreceptor 4-6 | Support A | present | Coating solution P | 0.1 | 1.2 | 20 | Coating solution a | 0 | 0.8 | 0.15 | 0.15 |
| Photoreceptor 4-7 | Support A | present | Coating solution R | 0.1 | 1.2 | 20 | Coating solution n | 0 | 0.7 | 0.15 | 0.15 |

<2> Evaluation of Electrophotographic Photoreceptor (Electrophotographic Photoreceptors 1-1 to 1-92, 2-1 to 2-49, 3-1 to 3-92, and 4-1 to 4-7)

The electrophotographic photoreceptors produced above were mounted on a laser beam printer X or Y shown below. On this occasion, a spacing member (cylinder made of a polyoxymethylene material) was abutted against each of both end parts (the upper part and the lower part in dip coating are referred to as "upper end part" and "lower end part", respectively) of the electrophotographic photoreceptor for maintaining the distance between the electrophotographic photoreceptor and the developer carrying member. The central position of each abutting was at 9 mm from one end part of the photoreceptor. The image forming region of the electrophotographic photoreceptor was a region excluding the upper part of about 20 mm from the upper end and the lower part of about 20 mm from the lower end.

Laser beam printer X: HP LaserJet Enterprise 600M603 (manufactured by Hewlett-Packard Company), non-contact developing system, printing speed: 60 sheets/min in A4 vertical format, width of spacing member: 4 mm Laser beam printer Y: HP LaserJet Enterprise 500 Color M551 (manufactured by Hewlett-Packard Company); contact developing system, printing speed: 30 sheets/min in A4 vertical format, width of spacing member: 2 mm Both laser beam printers were modified such that the pressures (abutting forces) applied to the upper end part and the lower end part of the electrophotographic photoreceptor from the respective spacing members can be independently controlled.

An image was printed on 500000 sheets of A4 size plain paper at a printing rate of 1% with the laser beam printer provided with any of these electrophotographic photoreceptors under an environment of a temperature of 30° C. and a relative humidity of 90% with an intermittent operation mode of stopping the printing every printing on two sheets of paper. The surface of the electrophotographic photoreceptor in the region abutting against the spacing member was visually observed every 100000 sheets of paper to evaluate the effect of preventing peeling of the layer. The evaluation criteria are as follows:

A: no change was observed;

B: slight lifting was observed;

C: partial lifting was observed, but no peeling was observed; and

D: peeling was observed.

The types of the electrophotographic photoreceptor and laser beam printer used, the abutting forces applied to the upper end part and the lower end part of each photoreceptor, and the results of evaluation are shown in the following tables.

TABLE 7

Evaluation conditions and evaluation results

| | | Evaluation conditions | | | Evaluation results | | | | |
|---|---|---|---|---|---|---|---|---|---|
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 1-1 | Photoreceptor 1-1 | X (4 mm) | 700 | 2300 | A | B | B | C | C |
| Example 1-2 | Photoreceptor 1-2 | X (4 mm) | 700 | 2300 | A | B | C | C | C |
| Example 1-3 | Photoreceptor 1-3 | X (4 mm) | 700 | 2300 | A | B | B | C | C |
| Example 1-4 | Photoreceptor 1-4 | X (4 mm) | 700 | 2300 | A | B | C | C | C |
| Example 1-5 | Photoreceptor 1-5 | X (4 mm) | 700 | 2300 | A | B | B | B | C |
| Example 1-6 | Photoreceptor 1-6 | X (4 mm) | 700 | 2300 | A | B | B | B | C |
| Example 1-7 | Photoreceptor 1-7 | X (4 mm) | 700 | 2300 | A | A | B | B | C |
| Example 1-8 | Photoreceptor 1-8 | X (4 mm) | 700 | 2300 | A | A | B | B | C |
| Example 1-9 | Photoreceptor 1-9 | X (4 mm) | 700 | 2300 | A | B | B | B | C |
| Example 1-10 | Photoreceptor 1-10 | X (4 mm) | 700 | 2300 | A | B | B | B | C |
| Example 1-11 | Photoreceptor 1-11 | X (4 mm) | 700 | 2300 | A | A | B | B | C |
| Example 1-12 | Photoreceptor 1-12 | X (4 mm) | 700 | 2300 | A | A | B | B | C |
| Example 1-13 | Photoreceptor 1-13 | X (4 mm) | 700 | 2300 | A | B | B | B | C |
| Example 1-14 | Photoreceptor 1-14 | X (4 mm) | 700 | 2300 | A | B | B | B | C |
| Example 1-15 | Photoreceptor 1-15 | X (4 mm) | 700 | 2300 | A | A | B | B | C |
| Example 1-16 | Photoreceptor 1-16 | X (4 mm) | 700 | 2300 | A | A | B | B | C |
| Example 1-17 | Photoreceptor 1-17 | X (4 mm) | 700 | 2300 | A | B | B | B | C |
| Example 1-18 | Photoreceptor 1-18 | X (4 mm) | 700 | 2300 | A | B | B | B | C |
| Example 1-19 | Photoreceptor 1-19 | X (4 mm) | 700 | 2300 | A | A | B | B | C |
| Example 1-20 | Photoreceptor 1-20 | X (4 mm) | 700 | 2300 | A | A | B | B | C |
| Example 1-21 | Photoreceptor 1-21 | X (4 mm) | 700 | 2300 | A | A | B | B | C |
| Example 1-22 | Photoreceptor 1-22 | X (4 mm) | 700 | 2300 | A | A | B | B | C |
| Example 1-23 | Photoreceptor 1-23 | Y (2 mm) | 500 | 1100 | A | A | B | B | B |
| Example 1-24 | Photoreceptor 1-24 | Y (2 mm) | 500 | 1100 | A | A | B | B | B |
| Example 1-25 | Photoreceptor 1-25 | X (4 mm) | 700 | 2300 | A | A | B | B | B |
| Example 1-26 | Photoreceptor 1-26 | X (4 mm) | 700 | 2300 | A | A | B | B | C |
| Example 1-27 | Photoreceptor 1-27 | X (4 mm) | 700 | 2300 | A | A | A | B | B |
| Example 1-28 | Photoreceptor 1-28 | X (4 mm) | 700 | 2300 | A | A | A | B | B |
| Example 1-29 | Photoreceptor 1-29 | X (4 mm) | 700 | 2300 | A | A | A | B | B |
| Example 1-30 | Photoreceptor 1-30 | X (4 mm) | 700 | 2300 | A | A | A | B | B |
| Example 1-31 | Photoreceptor 1-31 | X (4 mm) | 700 | 2300 | A | A | A | B | B |
| Example 1-32 | Photoreceptor 1-32 | X (4 mm) | 700 | 2300 | A | A | A | B | B |
| Example 1-33 | Photoreceptor 1-33 | X (4 mm) | 700 | 2300 | A | A | A | B | B |
| Example 1-34 | Photoreceptor 1-34 | X (4 mm) | 700 | 2300 | A | A | A | B | B |
| Example 1-35 | Photoreceptor 1-35 | X (4 mm) | 700 | 2300 | A | A | A | B | B |
| Example 1-36 | Photoreceptor 1-36 | X (4 mm) | 700 | 2300 | A | A | A | B | B |
| Example 1-37 | Photoreceptor 1-37 | X (4 mm) | 700 | 2300 | A | A | A | B | B |
| Example 1-38 | Photoreceptor 1-38 | X (4 mm) | 700 | 2300 | A | A | A | B | B |
| Example 1-39 | Photoreceptor 1-39 | X (4 mm) | 700 | 2300 | A | A | A | B | B |
| Example 1-40 | Photoreceptor 1-40 | X (4 mm) | 700 | 2300 | A | A | A | B | B |
| Example 1-41 | Photoreceptor 1-41 | X (4 mm) | 700 | 2300 | A | A | A | B | B |
| Example 1-42 | Photoreceptor 1-42 | X (4 mm) | 700 | 2300 | A | A | A | B | B |
| Example 1-43 | Photoreceptor 1-43 | X (4 mm) | 700 | 2300 | A | A | A | B | B |
| Example 1-44 | Photoreceptor 1-44 | X (4 mm) | 700 | 2300 | A | A | A | B | B |
| Example 1-45 | Photoreceptor 1-45 | X (4 mm) | 2300 | 2300 | A | A | A | B | B |

TABLE 8

Evaluation conditions and evaluation results

| | | Evaluation conditions | | | Evaluation results | | | | |
|---|---|---|---|---|---|---|---|---|---|
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 1-46 | Photoreceptor 1-46 | X (4 mm) | 2300 | 2300 | A | A | A | B | B |
| Example 1-47 | Photoreceptor 1-47 | X (4 mm) | 2300 | 2300 | A | A | A | B | B |

TABLE 8-continued

| Evaluation conditions and evaluation results | | | | | | | | | |
|---|---|---|---|---|---|---|---|---|---|
| | | Evaluation conditions | | | Evaluation results | | | | |
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 1-48 | Photoreceptor 1-48 | X (4 mm) | 2300 | 2300 | A | A | A | A | B |
| Example 1-49 | Photoreceptor 1-49 | X (4 mm) | 2300 | 2300 | A | A | A | B | B |
| Example 1-50 | Photoreceptor 1-50 | X (4 mm) | 2300 | 2300 | A | A | A | B | B |
| Example 1-51 | Photoreceptor 1-51 | X (4 mm) | 2300 | 2300 | A | A | A | B | B |
| Example 1-52 | Photoreceptor 1-52 | X (4 mm) | 2300 | 2300 | A | A | B | B | B |
| Example 1-53 | Photoreceptor 1-53 | X (4 mm) | 2300 | 2300 | A | A | A | B | B |
| Example 1-54 | Photoreceptor 1-54 | X (4 mm) | 2300 | 2300 | A | A | A | B | B |
| Example 1-55 | Photoreceptor 1-55 | X (4 mm) | 2300 | 2300 | A | A | A | B | B |
| Example 1-56 | Photoreceptor 1-56 | X (4 mm) | 2300 | 2300 | A | A | A | B | B |
| Example 1-57 | Photoreceptor 1-57 | X (4 mm) | 2300 | 2300 | A | A | A | B | A |
| Example 1-58 | Photoreceptor 1-58 | X (4 mm) | 2300 | 2300 | A | A | A | B | A |
| Example 1-59 | Photoreceptor 1-59 | X (4 mm) | 700 | 2000 | A | A | A | A | A |
| Example 1-60 | Photoreceptor 1-60 | X (4 mm) | 700 | 2000 | A | A | A | B | B |
| Example 1-61 | Photoreceptor 1-61 | X (4 mm) | 700 | 2500 | A | A | A | B | B |
| Example 1-62 | Photoreceptor 1-62 | X (4 mm) | 700 | 2500 | A | A | A | A | B |
| Example 1-63 | Photoreceptor 1-63 | X (4 mm) | 700 | 2800 | A | A | A | B | B |
| Example 1-64 | Photoreceptor 1-64 | X (4 mm) | 700 | 2800 | A | A | A | A | B |
| Example 1-65 | Photoreceptor 1-65 | Y (2 mm) | 1100 | 1100 | A | A | A | A | B |
| Example 1-66 | Photoreceptor 1-66 | Y (2 mm) | 1100 | 1100 | A | A | A | B | B |
| Example 1-67 | Photoreceptor 1-67 | Y (2 mm) | 1100 | 1100 | A | A | A | B | B |
| Example 1-68 | Photoreceptor 1-68 | Y (2 mm) | 1100 | 1100 | A | A | A | A | B |
| Example 1-69 | Photoreceptor 1-69 | Y (2 mm) | 1100 | 1100 | A | A | A | A | B |
| Example 1-70 | Photoreceptor 1-70 | Y (2 mm) | 1100 | 1100 | A | A | A | B | B |
| Example 1-71 | Photoreceptor 1-71 | Y (2 mm) | 1100 | 1100 | A | A | B | B | B |
| Example 1-72 | Photoreceptor 1-72 | Y (2 mm) | 900 | 900 | A | A | A | A | B |
| Example 1-73 | Photoreceptor 1-73 | Y (2 mm) | 900 | 900 | A | A | A | A | B |
| Example 1-74 | Photoreceptor 1-74 | Y (2 mm) | 1400 | 1400 | A | A | A | B | B |
| Example 1-75 | Photoreceptor 1-75 | Y (2 mm) | 1400 | 1400 | A | A | A | A | B |
| Example 1-76 | Photoreceptor 1-76 | Y (2 mm) | 1900 | 1900 | A | A | A | B | B |
| Example 1-77 | Photoreceptor 1-77 | Y (2 mm) | 1900 | 1900 | A | A | A | A | B |
| Example 1-78 | Photoreceptor 1-78 | X (4 mm) | 700 | 2300 | A | A | A | A | A |
| Example 1-79 | Photoreceptor 1-79 | X (4 mm) | 700 | 2700 | A | A | A | A | B |
| Example 1-80 | Photoreceptor 1-80 | X (4 mm) | 700 | 2700 | A | A | A | A | A |
| Example 1-81 | Photoreceptor 1-81 | Y (2 mm) | 500 | 1400 | A | A | A | A | A |
| Example 1-82 | Photoreceptor 1-82 | Y (2 mm) | 500 | 1900 | A | A | A | A | A |
| Example 1-83 | Photoreceptor 1-83 | Y (2 mm) | 500 | 1900 | A | A | A | A | B |
| Example 1-84 | Photoreceptor 1-84 | Y (2 mm) | 500 | 1700 | A | A | A | A | A |
| Example 1-85 | Photoreceptor 1-85 | X (4 mm) | 2300 | 2300 | A | A | A | A | B |
| Example 1-86 | Photoreceptor 1-86 | X (4 mm) | 2300 | 2500 | A | A | A | A | B |
| Example 1-87 | Photoreceptor 1-92 | X (4 mm) | 700 | 2300 | A | A | A | A | A |
| Comparative Example 1-1 | Photoreceptor 1-87 | X (4 mm) | 700 | 2300 | B | C | C | C | D |
| Comparative Example 1-2 | Photoreceptor 1-88 | X (4 mm) | 700 | 2300 | B | C | C | C | D |
| Comparative Example 1-3 | Photoreceptor 1-89 | X (4 mm) | 700 | 2300 | B | C | C | C | D |
| Comparative Example 1-4 | Photoreceptor 1-90 | X (4 mm) | 700 | 2300 | B | C | C | C | D |
| Comparative Example 1-5 | Photoreceptor 1-91 | X (4 mm) | 700 | 2300 | B | C | D | D | D |

TABLE 9

| Evaluation conditions and evaluation results | | | | | | | | | |
|---|---|---|---|---|---|---|---|---|---|
| | | Evaluation conditions | | | Evaluation results | | | | |
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 2-1 | Photoreceptor 2-1 | X (4 mm) | 2300 | 2300 | A | B | B | C | C |
| Example 2-2 | Photoreceptor 2-2 | X (4 mm) | 2300 | 2300 | A | B | C | C | C |
| Example 2-3 | Photoreceptor 2-3 | X (4 mm) | 2300 | 2300 | A | B | B | C | C |
| Example 2-4 | Photoreceptor 2-4 | X (4 mm) | 2300 | 2300 | A | B | C | C | C |
| Example 2-5 | Photoreceptor 2-5 | X (4 mm) | 2300 | 2300 | A | B | B | B | C |
| Example 2-6 | Photoreceptor 2-6 | X (4 mm) | 2300 | 2300 | A | B | B | B | C |
| Example 2-7 | Photoreceptor 2-7 | X (4 mm) | 2300 | 2300 | A | A | B | B | C |
| Example 2-8 | Photoreceptor 2-8 | X (4 mm) | 2300 | 2300 | A | A | B | B | C |
| Example 2-9 | Photoreceptor 2-9 | X (4 mm) | 2300 | 2300 | A | B | B | B | C |
| Example 2-10 | Photoreceptor 2-10 | X (4 mm) | 2300 | 2300 | A | B | B | B | C |
| Example 2-11 | Photoreceptor 2-11 | X (4 mm) | 2300 | 2300 | A | A | B | B | C |

TABLE 9-continued

| Evaluation conditions and evaluation results | | | | | | | | | |
|---|---|---|---|---|---|---|---|---|---|
| | | Evaluation conditions | | | Evaluation results | | | | |
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 2-12 | Photoreceptor 2-12 | X (4 mm) | 2300 | 2300 | A | A | B | B | C |
| Example 2-13 | Photoreceptor 2-13 | X (4 mm) | 2300 | 2300 | A | B | B | B | C |
| Example 2-14 | Photoreceptor 2-14 | X (4 mm) | 2300 | 2300 | A | B | B | B | C |
| Example 2-15 | Photoreceptor 2-15 | X (4 mm) | 2300 | 2300 | A | A | B | B | C |
| Example 2-16 | Photoreceptor 2-16 | X (4 mm) | 2300 | 2300 | A | A | B | B | C |
| Example 2-17 | Photoreceptor 2-17 | X (4 mm) | 2300 | 2300 | A | B | B | B | C |
| Example 2-18 | Photoreceptor 2-18 | X (4 mm) | 2300 | 2300 | A | B | B | B | C |
| Example 2-19 | Photoreceptor 2-19 | X (4 mm) | 2300 | 2300 | A | A | B | B | C |
| Example 2-20 | Photoreceptor 2-20 | X (4 mm) | 2300 | 2300 | A | A | B | B | C |
| Example 2-21 | Photoreceptor 2-21 | X (4 mm) | 2300 | 2300 | A | A | B | B | C |
| Example 2-22 | Photoreceptor 2-22 | X (4 mm) | 2300 | 2300 | A | A | B | B | C |
| Example 2-23 | Photoreceptor 2-23 | Y (2 mm) | 1100 | 1100 | A | A | B | B | B |
| Example 2-24 | Photoreceptor 2-24 | Y (2 mm) | 1100 | 1100 | A | A | B | B | B |
| Example 2-25 | Photoreceptor 2-25 | X (4 mm) | 2300 | 2300 | A | A | B | B | B |
| Example 2-26 | Photoreceptor 2-26 | X (4 mm) | 2300 | 2300 | A | A | B | B | C |
| Example 2-27 | Photoreceptor 2-27 | X (4 mm) | 2300 | 2300 | A | A | A | B | B |
| Example 2-28 | Photoreceptor 2-28 | X (4 mm) | 2300 | 2300 | A | A | A | B | B |
| Example 2-29 | Photoreceptor 2-29 | X (4 mm) | 2300 | 2300 | A | A | A | B | B |
| Example 2-30 | Photoreceptor 2-30 | X (4 mm) | 2300 | 2300 | A | A | A | B | B |
| Example 2-31 | Photoreceptor 2-31 | X (4 mm) | 2300 | 2300 | A | A | A | B | B |
| Example 2-32 | Photoreceptor 2-32 | X (4 mm) | 2300 | 2300 | A | A | A | B | B |
| Example 2-33 | Photoreceptor 2-33 | X (4 mm) | 2300 | 2300 | A | A | A | B | B |
| Example 2-34 | Photoreceptor 2-34 | X (4 mm) | 2300 | 2300 | A | A | A | B | B |
| Example 2-35 | Photoreceptor 2-35 | X (4 mm) | 2300 | 2300 | A | A | A | B | B |
| Example 2-36 | Photoreceptor 2-36 | X (4 mm) | 2300 | 2300 | A | A | A | B | B |
| Example 2-37 | Photoreceptor 2-37 | X (4 mm) | 2300 | 2300 | A | A | A | B | B |
| Example 2-38 | Photoreceptor 2-38 | X (4 mm) | 2300 | 2300 | A | A | A | B | B |
| Example 2-39 | Photoreceptor 2-39 | X (4 mm) | 2300 | 2300 | A | A | A | B | B |
| Example 2-40 | Photoreceptor 2-40 | X (4 mm) | 2300 | 2300 | A | A | A | B | B |
| Example 2-41 | Photoreceptor 2-41 | X (4 mm) | 2300 | 2300 | A | A | A | B | B |
| Example 2-42 | Photoreceptor 2-42 | X (4 mm) | 2300 | 2300 | A | A | A | B | B |
| Example 2-43 | Photoreceptor 2-43 | X (4 mm) | 2300 | 2300 | A | A | A | B | B |
| Example 2-44 | Photoreceptor 2-44 | X (4 mm) | 2300 | 2300 | A | A | A | B | B |
| Comparative Example 2-1 | Photoreceptor 2-45 | X (4 mm) | 2300 | 2300 | B | C | C | C | D |
| Comparative Example 2-2 | Photoreceptor 2-46 | X (4 mm) | 2300 | 2300 | B | C | C | C | D |
| Comparative Example 2-3 | Photoreceptor 2-47 | X (4 mm) | 2300 | 2300 | B | C | C | C | D |
| Comparative Example 2-4 | Photoreceptor 2-48 | X (4 mm) | 2300 | 2300 | B | C | C | C | D |
| Comparative Example 2-5 | Photoreceptor 2-49 | X (4 mm) | 2300 | 2300 | B | C | D | D | D |

TABLE 10

| Evaluation conditions and evaluation results | | | | | | | | | |
|---|---|---|---|---|---|---|---|---|---|
| | | Evaluation conditions | | | Evaluation results | | | | |
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 3-1 | Photoreceptor 3-1 | X (4 mm) | 700 | 2300 | A | B | B | C | C |
| Example 3-2 | Photoreceptor 3-2 | X (4 mm) | 700 | 2300 | A | B | C | C | C |
| Example 3-3 | Photoreceptor 3-3 | X (4 mm) | 700 | 2300 | A | B | B | C | C |
| Example 3-4 | Photoreceptor 3-4 | X (4 mm) | 700 | 2300 | A | B | C | C | C |
| Example 3-5 | Photoreceptor 3-5 | X (4 mm) | 700 | 2300 | A | B | B | B | C |
| Example 3-6 | Photoreceptor 3-6 | X (4 mm) | 700 | 2300 | A | B | B | B | C |
| Example 3-7 | Photoreceptor 3-7 | X (4 mm) | 700 | 2300 | A | A | B | B | C |
| Example 3-8 | Photoreceptor 3-8 | X (4 mm) | 700 | 2300 | A | A | B | B | C |
| Example 3-9 | Photoreceptor 3-9 | X (4 mm) | 700 | 2300 | A | B | B | B | C |
| Example 3-10 | Photoreceptor 3-10 | X (4 mm) | 700 | 2300 | A | B | B | B | C |
| Example 3-11 | Photoreceptor 3-11 | X (4 mm) | 700 | 2300 | A | A | B | B | C |
| Example 3-12 | Photoreceptor 3-12 | X (4 mm) | 700 | 2300 | A | A | B | B | C |
| Example 3-13 | Photoreceptor 3-13 | X (4 mm) | 700 | 2300 | A | B | B | B | C |
| Example 3-14 | Photoreceptor 3-14 | X (4 mm) | 700 | 2300 | A | B | B | B | C |
| Example 3-15 | Photoreceptor 3-15 | X (4 mm) | 700 | 2300 | A | A | B | B | C |
| Example 3-16 | Photoreceptor 3-16 | X (4 mm) | 700 | 2300 | A | A | B | B | C |
| Example 3-17 | Photoreceptor 3-17 | X (4 mm) | 700 | 2300 | A | B | B | B | C |

TABLE 10-continued

| Evaluation conditions and evaluation results | | | | | | | | | |
|---|---|---|---|---|---|---|---|---|---|
| | | Evaluation conditions | | | Evaluation results | | | | |
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 3-18 | Photoreceptor 3-18 | X (4 mm) | 700 | 2300 | A | B | B | B | C |
| Example 3-19 | Photoreceptor 3-19 | X (4 mm) | 700 | 2300 | A | A | B | B | C |
| Example 3-20 | Photoreceptor 3-20 | X (4 mm) | 700 | 2300 | A | A | B | B | C |
| Example 3-21 | Photoreceptor 3-21 | X (4 mm) | 700 | 2300 | A | A | B | B | C |
| Example 3-22 | Photoreceptor 3-22 | X (4 mm) | 700 | 2300 | A | A | B | B | C |
| Example 3-23 | Photoreceptor 3-23 | Y (2 mm) | 500 | 1100 | A | A | B | B | B |
| Example 3-24 | Photoreceptor 3-24 | Y (2 mm) | 500 | 1100 | A | A | B | B | B |
| Example 3-25 | Photoreceptor 3-25 | X (4 mm) | 700 | 2300 | A | A | B | B | B |
| Example 3-26 | Photoreceptor 3-26 | X (4 mm) | 700 | 2300 | A | A | B | B | C |
| Example 3-27 | Photoreceptor 3-27 | X (4 mm) | 700 | 2300 | A | A | A | B | B |
| Example 3-28 | Photoreceptor 3-28 | X (4 mm) | 700 | 2300 | A | A | A | B | B |
| Example 3-29 | Photoreceptor 3-29 | X (4 mm) | 700 | 2300 | A | A | A | B | B |
| Example 3-30 | Photoreceptor 3-30 | X (4 mm) | 700 | 2300 | A | A | A | B | B |
| Example 3-31 | Photoreceptor 3-31 | X (4 mm) | 700 | 2300 | A | A | A | B | B |
| Example 3-32 | Photoreceptor 3-32 | X (4 mm) | 700 | 2300 | A | A | A | B | B |
| Example 3-33 | Photoreceptor 3-33 | X (4 mm) | 700 | 2300 | A | A | A | B | B |
| Example 3-34 | Photoreceptor 3-34 | X (4 mm) | 700 | 2300 | A | A | A | B | B |
| Example 3-35 | Photoreceptor 3-35 | X (4 mm) | 700 | 2300 | A | A | A | B | B |
| Example 3-36 | Photoreceptor 3-36 | X (4 mm) | 700 | 2300 | A | A | A | B | B |
| Example 3-37 | Photoreceptor 3-37 | X (4 mm) | 700 | 2300 | A | A | A | B | B |
| Example 3-38 | Photoreceptor 3-38 | X (4 mm) | 700 | 2300 | A | A | A | B | B |
| Example 3-39 | Photoreceptor 3-39 | X (4 mm) | 700 | 2300 | A | A | A | B | B |
| Example 3-40 | Photoreceptor 3-40 | X (4 mm) | 700 | 2300 | A | A | A | B | B |
| Example 3-41 | Photoreceptor 3-41 | X (4 mm) | 700 | 2300 | A | A | A | B | B |
| Example 3-42 | Photoreceptor 3-42 | X (4 mm) | 700 | 2300 | A | A | A | B | B |
| Example 3-43 | Photoreceptor 3-43 | X (4 mm) | 700 | 2300 | A | A | A | B | B |
| Example 3-44 | Photoreceptor 3-44 | X (4 mm) | 700 | 2300 | A | A | A | B | B |
| Example 3-45 | Photoreceptor 3-45 | X (4 mm) | 2300 | 2300 | A | A | A | B | B |

TABLE 11

| Evaluation conditions and evaluation results | | | | | | | | | |
|---|---|---|---|---|---|---|---|---|---|
| | | Evaluation conditions | | | Evaluation results | | | | |
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 3-46 | Photoreceptor 3-46 | X (4 mm) | 2300 | 2300 | A | A | A | B | B |
| Example 3-47 | Photoreceptor 3-47 | X (4 mm) | 2300 | 2300 | A | A | A | B | B |
| Example 3-48 | Photoreceptor 3-48 | X (4 mm) | 2300 | 2300 | A | A | A | A | B |
| Example 3-49 | Photoreceptor 3-49 | X (4 mm) | 2300 | 2300 | A | A | A | B | B |
| Example 3-50 | Photoreceptor 3-50 | X (4 mm) | 2300 | 2300 | A | A | A | B | B |
| Example 3-51 | Photoreceptor 3-51 | X (4 mm) | 2300 | 2300 | A | A | A | B | B |
| Example 3-52 | Photoreceptor 3-52 | X (4 mm) | 2300 | 2300 | A | A | B | B | B |
| Example 3-53 | Photoreceptor 3-53 | X (4 mm) | 2300 | 2300 | A | A | A | B | B |
| Example 3-54 | Photoreceptor 3-54 | X (4 mm) | 2300 | 2300 | A | A | A | B | B |
| Example 3-55 | Photoreceptor 3-55 | X (4 mm) | 2300 | 2300 | A | A | A | B | B |
| Example 3-56 | Photoreceptor 3-56 | X (4 mm) | 2300 | 2300 | A | A | A | B | B |
| Example 3-57 | Photoreceptor 3-57 | X (4 mm) | 2300 | 2300 | A | A | A | B | B |
| Example 3-58 | Photoreceptor 3-58 | X (4 mm) | 2300 | 2300 | A | A | A | B | B |
| Example 3-59 | Photoreceptor 3-59 | X (4 mm) | 700 | 2000 | A | A | A | A | A |
| Example 3-60 | Photoreceptor 3-60 | X (4 mm) | 700 | 2000 | A | A | A | B | B |
| Example 3-61 | Photoreceptor 3-61 | X (4 mm) | 700 | 2500 | A | A | A | B | B |
| Example 3-62 | Photoreceptor 3-62 | X (4 mm) | 700 | 2500 | A | A | A | A | B |
| Example 3-63 | Photoreceptor 3-63 | X (4 mm) | 700 | 2800 | A | A | A | B | B |
| Example 3-64 | Photoreceptor 3-64 | X (4 mm) | 700 | 2800 | A | A | A | A | B |
| Example 3-65 | Photoreceptor 3-65 | Y (2 mm) | 1100 | 1100 | A | A | A | A | B |
| Example 3-66 | Photoreceptor 3-66 | Y (2 mm) | 1100 | 1100 | A | A | A | B | B |
| Example 3-67 | Photoreceptor 3-67 | Y (2 mm) | 1100 | 1100 | A | A | A | B | B |
| Example 3-68 | Photoreceptor 3-68 | Y (2 mm) | 1100 | 1100 | A | A | A | A | B |
| Example 3-69 | Photoreceptor 3-69 | Y (2 mm) | 1100 | 1100 | A | A | A | A | B |
| Example 3-70 | Photoreceptor 3-70 | Y (2 mm) | 1100 | 1100 | A | A | A | B | B |
| Example 3-71 | Photoreceptor 3-71 | Y (2 mm) | 1100 | 1100 | A | A | B | B | B |
| Example 3-72 | Photoreceptor 3-72 | Y (2 mm) | 900 | 900 | A | A | A | A | B |
| Example 3-73 | Photoreceptor 3-73 | Y (2 mm) | 900 | 900 | A | A | A | A | B |

TABLE 11-continued

| Evaluation conditions and evaluation results | | | | | | | | | |
|---|---|---|---|---|---|---|---|---|---|
| | | Evaluation conditions | | | Evaluation results | | | | |
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 3-74 | Photoreceptor 3-74 | Y (2 mm) | 1400 | 1400 | A | A | A | B | B |
| Example 3-75 | Photoreceptor 3-75 | Y (2 mm) | 1400 | 1400 | A | A | A | A | B |
| Example 3-76 | Photoreceptor 3-76 | Y (2 mm) | 1900 | 1900 | A | A | A | B | B |
| Example 3-77 | Photoreceptor 3-77 | Y (2 mm) | 1900 | 1900 | A | A | A | A | B |
| Example 3-78 | Photoreceptor 3-78 | X (4 mm) | 700 | 2300 | A | A | A | A | A |
| Example 3-79 | Photoreceptor 3-79 | X (4 mm) | 700 | 2700 | A | A | A | A | B |
| Example 3-80 | Photoreceptor 3-80 | X (4 mm) | 700 | 2700 | A | A | A | A | A |
| Example 3-81 | Photoreceptor 3-81 | Y (2 mm) | 500 | 1400 | A | A | A | A | A |
| Example 3-82 | Photoreceptor 3-82 | Y (2 mm) | 500 | 1900 | A | A | A | A | A |
| Example 3-83 | Photoreceptor 3-83 | Y (2 mm) | 500 | 1900 | A | A | A | A | B |
| Example 3-84 | Photoreceptor 3-84 | Y (2 mm) | 500 | 1700 | A | A | A | A | A |
| Example 3-85 | Photoreceptor 3-85 | X (4 mm) | 2300 | 2300 | A | A | A | A | B |
| Example 3-86 | Photoreceptor 3-86 | X (4 mm) | 2300 | 2500 | A | A | A | A | B |
| Example 3-87 | Photoreceptor 3-92 | X (4 mm) | 700 | 2300 | A | A | A | A | A |
| Comparative Example 3-1 | Photoreceptor 3-87 | X (4 mm) | 700 | 2300 | B | C | C | C | D |
| Comparative Example 3-2 | Photoreceptor 3-88 | X (4 mm) | 700 | 2300 | B | C | C | C | D |
| Comparative Example 3-3 | Photoreceptor 3-89 | X (4 mm) | 700 | 2300 | B | C | C | C | D |
| Comparative Example 3-4 | Photoreceptor 3-90 | X (4 mm) | 700 | 2300 | B | C | C | C | D |
| Comparative Example 3-5 | Photoreceptor 3-91 | X (4 mm) | 700 | 2300 | B | C | D | D | D |

TABLE 12

| Evaluation conditions and evaluation results | | | | | | | | | |
|---|---|---|---|---|---|---|---|---|---|
| | | Evaluation conditions | | | Evaluation results | | | | |
| Example No. | Photoreceptor No. | Type of printer (abutting width) | Abutting force at the upper end (gf) | Abutting force at the lower end (gf) | 100000 sheets | 200000 sheets | 300000 sheets | 400000 sheets | 500000 sheets |
| Example 4-1 | Photoreceptor 4-1 | X (4 mm) | 700 | 2300 | A | A | A | A | A |
| Example 4-2 | Photoreceptor 4-2 | X (4 mm) | 700 | 2300 | A | A | A | A | A |
| Example 4-3 | Photoreceptor 4-3 | X (4 mm) | 700 | 2700 | A | A | A | A | A |
| Example 4-4 | Photoreceptor 4-4 | X (4 mm) | 2300 | 2300 | A | A | A | B | B |
| Example 4-5 | Photoreceptor 4-5 | X (4 mm) | 2300 | 2300 | A | A | A | A | A |
| Example 4-6 | Photoreceptor 4-6 | X (4 mm) | 2300 | 2300 | A | A | A | B | B |
| Example 4-7 | Photoreceptor 4-7 | X (4 mm) | 2300 | 2300 | A | A | A | B | B |

(Electrophotographic Photoreceptors 1-93 and 1-94)

Electrophotographic photoreceptors 1-93 and 1-94 were mounted on the Bk station of a color copier (iR-ADV C5255, manufactured by CANON KABUSHIKI KAISHA, two-component developing system, printing speed: 55 sheets/min in A4 horizontal format, width of end part sealing member: 5 mm). On this occasion, the end part sealing member was abutted against each end part of the electrophotographic photoreceptor for preventing leakage of the developer. The central position of each abutting was at 15 mm from one end part of the photoreceptor. The photoreceptors were evaluated in accordance with the process and criteria described above.

The results of evaluation of electrophotographic photoreceptors 1-93 and 1-94 were equivalent to the results of evaluation of Example 1-1 (Electrophotographic photoreceptor 1-1).

While the aspects of the present invention have been described with reference to exemplary embodiments, it is to be understood that the aspects of the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-201312, filed Oct. 9, 2015, which is hereby incorporated by reference herein in its entirety.

What is claimed is:

1. An electrophotographic photoreceptor abutting against at least one selected from a charging member for charging the electrophotographic photoreceptor and a developer carrying member for supplying a developer to the electrophotographic photoreceptor with an abutting member therebetween, wherein the electrophotographic photoreceptor has a first portion and a second portion being different from the first portion along the longitudinal direction of the photoreceptor and abuts against the abutting member in the second portion;

the electrophotographic photoreceptor includes a support, a charge generating layer containing a charge generation material, and a surface layer in this order;

the electrophotographic photoreceptor includes, in the first portion, an undercoat layer containing a polymer of a composition containing an electron transport material and a crosslinking agent so as to be contiguous with the surface of the charge generating layer facing the support; and the electrophotographic photoreceptor includes, in the second portion, at least one of:

(i) an intermediate layer disposed between and so as to be contiguous with the support and the charge generating layer; and (ii) an intermediate layer disposed between and so as to be contiguous with the charge generating layer and the surface layer, wherein the intermediate layers each have a Martens hardness of 500 N/mm$^2$ or less.

2. The electrophotographic photoreceptor according to claim 1, wherein the electrophotographic photoreceptor includes the intermediate layer only in the second portion.

3. The electrophotographic photoreceptor according to claim 1, wherein the intermediate layer has a Martens hardness of 100 N/mm$^2$ or less.

4. The electrophotographic photoreceptor according to claim 1, wherein the intermediate layer contains at least one selected from the group consisting of urethane resins, amino resins, polyamide resins, and polyacetal resins.

5. The electrophotographic photoreceptor according to claim 4, wherein the resin has a glass transition temperature of 100° C. or less.

6. The electrophotographic photoreceptor according to claim 1, wherein the intermediate layer has a surface having a ten-point average roughness $Rz_{JIS}$ (reference length: 0.8 mm) in accordance with JIS B 0601:2001 of 0.5 μm or more and 2.5 μm or less.

7. The electrophotographic photoreceptor according to claim 1, wherein the charge generating layer in the second portion has an average thickness smaller than that of the charge generating layer in the first portion.

8. A process cartridge detachably attachable to a main body of an electrophotographic apparatus, comprising:

an electrophotographic photoreceptor; and at least one selected from a charging member for charging the electrophotographic photoreceptor and a developer carrying member for supplying a developer to the electrophotographic photoreceptor, wherein the electrophotographic photoreceptor is abutted against at least one selected from the charging member and the developer carrying member with an abutting member therebetween;

the electrophotographic photoreceptor has a first portion and a second portion being different from the first portion along the longitudinal direction of the electrophotographic photoreceptor and abuts against the abutting member in the second portion;

the electrophotographic photoreceptor includes a support, a charge generating layer containing a charge generation material, and a surface layer in this order;

the electrophotographic photoreceptor includes, in the first portion, an undercoat layer containing a polymer of a composition containing an electron transport material and a crosslinking agent so as to be contiguous with the surface of the charge generating layer facing the support; and the electrophotographic photoreceptor includes, in the second portion, at least one of:

(i) an intermediate layer disposed between and so as to be contiguous with the support and the charge generating layer; and (ii) an intermediate layer disposed between and so as to be contiguous with the charge generating layer and the surface layer, wherein the intermediate layers each have a Martens hardness of 500 N/mm$^2$ or less.

9. The process cartridge according to claim 8, wherein the electrophotographic photoreceptor includes the intermediate layer only in the second portion.

10. The process cartridge according to claim 8, wherein the intermediate layer has a Martens hardness of 100 N/mm or less.

11. The process cartridge according to claim 8, wherein the intermediate layer contains at least one selected from the group consisting of urethane resins, amino resins, polyamide resins, and polyacetal resins.

12. The process cartridge according to claim 8, wherein the intermediate layer has a surface having a ten-point average roughness $Rz_{JIS}$ (reference length: 0.8 mm) in accordance with JIS B 0601:2001 of 0.5 μm or more and 2.5 μm or less.

13. The process cartridge according to claim 8, wherein the charge generating layer in the second portion has an average thickness smaller than that of the charge generating layer in the first portion.

14. An electrophotographic apparatus comprising:

an electrophotographic photoreceptor; and at least one selected from a charging member for charging the electrophotographic photoreceptor and a developer carrying member for supplying a developer to the electrophotographic photoreceptor, wherein the electrophotographic photoreceptor is abutted against at least one selected from the charging member and the developer carrying member with an abutting member therebetween;

the electrophotographic photoreceptor has a first portion and a second portion being different from the first portion along the longitudinal direction of the photoreceptor and abuts against the abutting member in the second portion;

the electrophotographic photoreceptor includes a support, a charge generating layer containing a charge generation material, and a surface layer in this order;

the electrophotographic photoreceptor includes, in the first portion, an undercoat layer containing a polymer of a composition containing an electron transport material and a crosslinking agent so as to be contiguous with the surface of the charge generating layer facing the support; and the electrophotographic photoreceptor includes, in the second portion, at least one of:

(i) an intermediate layer disposed between and so as to be contiguous with the support and the charge generating layer; and (ii) an intermediate layer disposed between and so as to be contiguous with the charge generating layer and the surface layer, wherein the intermediate layers each have a Martens hardness of 500 N/mm$^2$ or less.

15. The electrophotographic apparatus according to claim 14, wherein the electrophotographic photoreceptor includes the intermediate layer only in the second portion.

16. The electrophotographic apparatus according to claim 14, wherein the intermediate layer has a Martens hardness of 100 N/mm$^2$ or less.

17. The electrophotographic apparatus according to claim 14, wherein the intermediate layer contains at least one selected from the group consisting of urethane resins, amino resins, polyamide resins, and polyacetal resins.

18. The electrophotographic apparatus according to claim 14, wherein the intermediate layer has a surface having a ten-point average roughness $Rz_{JIS}$ (reference length: 0.8 mm) in accordance with JIS B 0601:2001 of 0.5 μm or more and 2.5 μm or less.

19. The electrophotographic apparatus according to claim 14, wherein the charge generating layer in the second portion has an average thickness smaller than that of the charge generating layer in the first portion.

* * * * *